US011162206B2

(12) United States Patent
Lv et al.

(10) Patent No.: US 11,162,206 B2
(45) Date of Patent: Nov. 2, 2021

(54) CLOTHING TREATMENT AGENT DISPENSING ASSEMBLY FOR USE WITH CLOTHING TREATMENT DEVICE, AND CLOTHING TREATMENT DEVICE

(71) Applicants: QINGDAO HAIER WASHING MACHINE CO., LTD., Shandong (CN); Haier Smart Home Co., Ltd., Shandong (CN)

(72) Inventors: Peishi Lv, Qingdao (CN); Sheng Xu, Qingdao (CN); Zhiqiang Zhao, Qingdao (CN); Xinyu Zhao, Qingdao (CN)

(73) Assignees: QINGDAO HAIER WASHING MACHINE CO., LTD., Qingdao (CN); Haier Smart Home Co., Ltd., Qingdao (CN)

( * ) Notice: Subject to any disclaimer, the term of this patent is extended or adjusted under 35 U.S.C. 154(b) by 30 days.

(21) Appl. No.: 16/771,403

(22) PCT Filed: Nov. 7, 2018

(86) PCT No.: PCT/CN2018/114290
§ 371 (c)(1),
(2) Date: Jun. 10, 2020

(87) PCT Pub. No.: WO2019/114465
PCT Pub. Date: Jun. 20, 2019

(65) Prior Publication Data

US 2020/0392662 A1 Dec. 17, 2020

(30) Foreign Application Priority Data

Dec. 11, 2017 (CN) ..... 201711310794.1
Dec. 11, 2017 (CN) ..... 201711311483.7
(Continued)

(51) Int. Cl.
*D06F 39/02* (2006.01)

(52) U.S. Cl.
CPC ..... *D06F 39/02* (2013.01)

(58) Field of Classification Search
CPC ..... D06F 39/02
See application file for complete search history.

(56) References Cited

FOREIGN PATENT DOCUMENTS

CN 103806255 A 5/2014
CN 204039768 U 12/2014
(Continued)

OTHER PUBLICATIONS

International Search Report dated Feb. 14, 2019 in corresponding International application No. PCT/CN2018/114290; 8 pages.

*Primary Examiner* — Jason Y Ko
(74) *Attorney, Agent, or Firm* — Maier & Maier, PLLC

(57) ABSTRACT

A clothing treatment agent dispensing assembly for use with a clothing treatment device, and a clothing treatment device; the device includes a body, and the clothing treatment agent dispensing assembly includes a storage container and a dispensing apparatus; the storage container is fixed in the body and is used for storing a clothing treatment agent; the dispensing apparatus may move relative to the storage container and is used for dispensing the clothing treatment agent; the clothing treatment agent dispensing assembly also comprises a sleeve apparatus, one end of the sleeve apparatus being in communication with the dispensing apparatus, while the other end is connected to the storage container such that the dispensing apparatus may move relative to the storage container while the clothing treatment agent in the dispensing device may still flow into the storage container. The sleeve assembly will not become blocked and tangled when the dispensing apparatus moves.

10 Claims, 22 Drawing Sheets

(30) Foreign Application Priority Data

Dec. 11, 2017 (CN) ..... 201711311571.7
Dec. 11, 2017 (CN) ..... 201711311716.3

(56) References Cited

FOREIGN PATENT DOCUMENTS

| | | | |
|---|---|---|---|
| CN | 107974807 | A | 5/2018 |
| CN | 207760579 | U | 8/2018 |
| CN | 207760580 | U | 8/2018 |
| CN | 208038838 | U | 11/2018 |
| CN | 208038839 | U | 11/2018 |
| KR | 20100081208 | A | 7/2010 |

CLOTHING TREATMENT AGENT DISPENSING ASSEMBLY FOR USE WITH CLOTHING TREATMENT DEVICE, AND CLOTHING TREATMENT DEVICE

FIELD

The present disclosure belongs to the technical field of clothing treatment, and specifically provides a clothing treatment agent dispensing assembly for a clothing treatment apparatus, as well as a clothing treatment apparatus.

BACKGROUND

A clothing treatment apparatus is a machine capable of washing, spin-drying and/or drying clothing. Common clothing treatment apparatuses include washing machines, shoe washers, dryers and integrated washing and drying machines, etc. With the continuous improvement of production technology level and the increasing demands of users, the functionality of existing clothing treatment apparatuses is gradually enhanced. Taking the washing machine as an example, it includes a body and a detergent dispensing assembly, and a detergent can be injected into a working chamber of the washing machine by the detergent dispensing assembly. Since the volume of a detergent box in the detergent dispensing assembly is relatively large, a larger force is required from the user to pull and push the detergent box when adding the detergent, which is inconvenient for the user to operate and reduces the user experience.

Therefore, there is a need in the art for a new clothing treatment agent dispensing assembly for a clothing treatment apparatus and a corresponding clothing treatment apparatus to solve the above problems.

SUMMARY

A clothing treatment agent dispensing assembly for a clothing treatment apparatus is provided. The clothing treatment apparatus includes a body, and the clothing treatment agent dispensing assembly includes a storage container and a dispensing device that are connected, wherein the storage container is fixedly disposed in the body and configured to store a clothing treatment agent, and the dispensing device is capable of moving relative to the storage container and is configured to dispense the clothing treatment agent.

A first embodiment of the present disclosure is to solve the problems of inconvenient dispensing of the clothing treatment agent of existing clothing treatment apparatuses and the poor user experience caused thereby. The clothing treatment agent dispensing assembly of the present disclosure further includes a sleeve device, one end of which is in communication with the dispensing device and the other end of which is in communication with the storage container, so that while the dispensing device is capable of moving relative to the storage container, the clothing treatment agent in the dispensing device can also flow into the storage container.

In a preferred technical solution of the above clothing treatment agent dispensing assembly, the dispensing device includes at least one dispensing cavity, the sleeve device includes at least one sleeve group corresponding to the dispensing cavity in a one-to-one correspondence, and each sleeve group communicates one dispensing cavity to the storage container.

In a preferred technical solution of the above clothing treatment agent dispensing assembly, each sleeve group includes a first end sleeve and a second end sleeve, the first end sleeve in communication with the dispensing cavity, the second end sleeve is in communication with the storage container, and the first end sleeve and the second end sleeve are sealingly sleeved with each other.

In a preferred technical solution of the above clothing treatment agent dispensing assembly, each sleeve group further includes at least one intermediate sleeve disposed between the first end sleeve and the second end sleeve, and two ends of the intermediate sleeve are sealingly sleeved with the first end sleeve and the second end sleeve respectively.

In a preferred technical solution of the above clothing treatment agent dispensing assembly, the clothing treatment agent includes a detergent and a softener, and the at least one dispensing cavity includes a detergent dispensing cavity and a softener dispensing cavity.

In a preferred technical solution of the above clothing treatment agent dispensing assembly, a bottom wall of the dispensing cavity is inclined downward in a direction toward the storage container, and/or a bottom wall of the storage container is inclined downward in a direction away from the dispensing device.

In a preferred technical solution of the above clothing treatment agent dispensing assembly, the first end sleeve is connected to the bottom of a rear side wall of the dispensing cavity, and the second end sleeve is connected to the top of a front side wall of the storage container.

In a preferred technical solution of the above clothing treatment agent dispensing assembly, the dispensing device is provided with a guide rail, the body is provided with a translation mechanism matching the guide rail, and the dispensing device is capable of translating between a retracted position and an extended position relative to the storage container through the cooperation of the guide rail and the translation mechanism.

In a preferred technical solution of the above clothing treatment agent dispensing assembly, the dispensing device further includes a trim panel, and when the dispensing device is in the retracted position, the trim panel is flush with an operation panel of the clothing treatment apparatus.

In a preferred technical solution of the above clothing treatment agent dispensing assembly, the clothing treatment agent dispensing assembly further includes an automatic ejection mechanism configured to automatically eject the dispensing device to the extended position.

In a preferred technical solution of the above clothing treatment agent dispensing assembly, a button is provided on the trim panel, and the button is configured to trigger the automatic ejection mechanism when pressed, so that the dispensing device is automatically ejected to the extended position.

In a preferred technical solution of the above clothing treatment agent dispensing assembly, the clothing treatment agent dispensing assembly further includes a locking mechanism which includes a locking hook disposed on the dispensing device or the body and a buckle correspondingly disposed on the body or the dispensing device, and when the dispensing device is in the retracted position, the locking hook engages with the buckle to lock the dispensing device in the retracted position.

In a preferred technical solution of the above clothing treatment agent dispensing assembly, the automatic ejection mechanism includes an elastic reset member, one end of which is connected to the body or the storage container, and the other end of which is connected to the dispensing device; and when the dispensing device is in the retracted position, the elastic reset member biases the dispensing device in a direction away from the storage container.

In a preferred technical solution of the above clothing treatment agent dispensing assembly, the clothing treatment agent dispensing assembly further includes a pumping device, which is in communication with the storage container and configured to pump the clothing treatment agent in the storage container to a working chamber of the clothing treatment apparatus.

Those skilled in the art can understand that in the preferred technical solutions of the first embodiment of the present disclosure, the dispensing device is connected to the storage container through the sleeve device; when the dispensing device is pulled out of the body, the sleeve device expands and keeps the dispensing device and the storage container in communication, so that when the clothing treatment agent is injected into the dispensing device, the clothing treatment agent can be delivered to the storage container through the sleeve device; as compared with the technical solution in the related art in which the dispensing device is communicated with the storage container through a connection hose, the dispensing device is connected to the storage container through a rigid connecting member (i.e., the sleeve device) in the present disclosure, thereby avoiding the problem that the connection hose would bend to cause blockage when the dispensing device is pulled out of the body and pushed into the body, which would otherwise affect the delivery and injection of the clothing treatment agent. At the same time, the sleeve device will not entangle during the process of expanding and contracting, and will not hinder the normal movement of the dispensing device relative to the body. With these arrangements, the user's operations may be facilitated and the user experience may be improved.

Further, the sleeve device is composed of a plurality of sleeve groups, with each sleeve group being capable of connecting one dispensing cavity with the storage container; that is, in practical applications, different clothing treatment agents may be injected into different dispensing cavities, then delivered to the storage container through the corresponding sleeve groups, and finally mixed to prepare for normal washing of the clothing treatment apparatus.

Still further, the number of sleeves in the sleeve groups and the length of each sleeve may be flexibly adjusted according to the structure and arrangement of the clothing treatment apparatus in practical applications; specifically, when the dispensing device moves relative to the storage container by a large moving distance, the number of sleeves and/or the length of the sleeve may be appropriately increased; and when the dispensing device moves relative to the storage container by a small moving distance, the number of sleeves and/or the length of the sleeve may be appropriately decreased. With such an arrangement, regardless of whether the dispensing device moves relative to the storage container by a large moving distance or a small moving distance, the delivering condition of the clothing treatment agent can be satisfied, so it is ensured that the clothing treatment agent in the dispensing device can be smoothly injected into the storage container.

Still yet further, the bottom wall of the dispensing cavity and the bottom wall of the storage container are each inclined, that is, the bottom wall of the dispensing cavity and the bottom wall of the storage container are each inclined downward and inward from the outside of the body. With such an arrangement, after the clothing treatment agent is injected into the dispensing cavity, the clothing treatment agent will flow toward the sleeve device along the bottom wall of the dispensing cavity, and when the clothing treatment agent in the sleeve device enters the storage container, the clothing treatment agent will also flow from the outside to the inside along the bottom wall of the storage container. These arrangements are more advantageous for the flow of the clothing treatment agent and can ensure that the dispensing operation is smoothly performed. Further, one end of the sleeve device is connected to the bottom of the rear side wall of the dispensing cavity, and the other end of the sleeve device is connected to the top of the front side of the storage container. With this arrangement, the clothing treatment agent in the dispensing device can flow into the storage container as completely as possible so that the storage container is filled with the clothing treatment agent, thereby ensuring that the space in the storage container can be utilized to the maximum extent.

Still further, the guide rail and the translation mechanism enable the dispensing device to be translated between the retracted position and the extended position, that is, the dispensing device can be pulled out of the body and pushed into the body; through the cooperation of the guide rail and the translation mechanism, the dispensing device can move in a set direction, that is, the dispensing device can be guided, so it is ensured that the dispensing device can be accurately pulled and pushed into place. Further, when the trim panel is in the retracted position, it is flush with the operation panel of the clothing treatment apparatus, which can improve the overall aesthetics of the clothing treatment apparatus.

Still further, triggering the automatic ejection mechanism by the button can further improve the convenience of the user's dispensing operation, that is, the user only needs to press the button, so the automatic ejection mechanism can eject the dispensing device to the extended position, thereby facilitating the user's injection operation on the clothing treatment agent and improving the efficiency of the user's dispensing operation in this way. Further, the locking mechanism can be used to lock the dispensing device when the dispensing device is in the retracted position, so that the dispensing device will not fall out of the body, which improves the structural stability of the dispensing device and enables the trim panel to always remain flush with the operation panel of the clothing treatment apparatus, thereby ensuring the overall aesthetics of the clothing treatment apparatus.

Still further, the elastic reset member can ensure that the dispensing device is biased when the dispensing device is in the retracted position, so that when the button is pressed by the user, the dispensing device can be smoothly ejected by the elastic reset member, thereby ensuring that the dispensing operation is smoothly performed.

Still further, the clothing treatment agent in the storage container can be delivered into the working chamber of the clothing treatment apparatus through the pumping device, thereby completing the automatic dispensing of the clothing treatment agent into the working chamber, ensuring the normal operation of the washing process of the clothing treatment apparatus, and enabling the clothing to be washed clean quickly.

A second embodiment of the present disclosure is to solve the problems of inconvenient dispensing of the clothing treatment agent of existing clothing treatment apparatuses and the poor user experience caused thereby. The clothing treatment agent dispensing assembly of the present disclosure further includes a communication device, which is configured to communicate the dispensing device with the storage container and allow the dispensing device to move relative to the storage container.

In a preferred technical solution of the above clothing treatment agent dispensing assembly, the communication device is provided in the form of an insertion connection device, wherein a part of the insertion connection device is disposed on the dispensing device, and another part of the insertion connection device is disposed on the storage container, so that when the dispensing device moves to the extended position relative to the storage container, the insertion connection device communicates the dispensing device with the storage container, thus enabling the clothing treatment agent in the dispensing device to flow into the storage container.

In a preferred technical solution of the above clothing treatment agent dispensing assembly, the dispensing device includes at least one dispensing cavity, the insertion connection device includes at least one insertion connection component corresponding to the dispensing cavity in a one-to-one correspondence, and each insertion connection component communicates one dispensing cavity to the storage container.

In a preferred technical solution of the above clothing treatment agent dispensing assembly, each insertion connection component includes a first flow channel member and a second flow channel member, the first flow channel member is in communication with the dispensing cavity and includes a clothing treatment agent outlet, the second channel member is in communication with the storage container and includes a clothing treatment agent inlet, and when the dispensing device moves to the extended position relative to the storage container, the clothing treatment agent outlet is sealingly butted with the clothing treatment agent inlet.

In a preferred technical solution of the above clothing treatment agent dispensing assembly, the first flow channel member is provided with an insertion tube that forms the clothing treatment agent outlet, the second flow channel member is provided with an insertion hole that forms the clothing treatment agent inlet, and when the dispensing device moves to the extended position relative to the storage container, the insertion tube and the insertion hole are sealingly engaged.

In a preferred technical solution of the above clothing treatment agent dispensing assembly, the first flow channel member is provided with an insertion hole that forms the clothing treatment agent outlet, the second flow channel member is provided with an insertion tube that forms the clothing treatment agent inlet, and when the dispensing device moves to the extended position relative to the storage container, the insertion hole and the insertion tube are sealingly engaged.

In a preferred technical solution of the above clothing treatment agent dispensing assembly, the insertion tube is provided with a first valve disc, which is attached to the clothing treatment agent outlet in a normal state and thus closes the clothing treatment agent outlet; the insertion hole is provided with a second valve disc, which is attached to the clothing treatment agent inlet in a normal state and thus closes the clothing treatment agent inlet; and the second valve disc is further provided with an outwardly extending jacking post; wherein when the insertion tube is engaged with the insertion hole, the insertion tube pushes the second valve disc and thus opens the clothing treatment agent inlet, and at the same time, the jacking post pushes the first valve disc and thus opens the clothing treatment agent outlet.

In a preferred technical solution of the above clothing treatment agent dispensing assembly, the first flow channel member includes a body portion extending downward from the dispensing cavity, and the insertion tube extends outward horizontally from the body portion; the second flow channel member includes a body section extending outward horizontally from the storage container and a vertical section extending upward from the body section, and the insertion hole is formed on an inner side of the vertical section.

In a preferred technical solution of the above clothing treatment agent dispensing assembly, a bottom wall of the body section of the second flow channel member is inclined downward in a direction away from the dispensing device.

In a preferred technical solution of the above clothing treatment agent dispensing assembly, a bottom wall of the dispensing cavity is inclined downward in a direction toward the storage container, and/or a bottom wall of the storage container is inclined downward in a direction away from the dispensing device.

In a preferred technical solution of the above clothing treatment agent dispensing assembly, the clothing treatment agent includes a detergent and a softener, and the at least one dispensing cavity includes a detergent dispensing cavity and a softener dispensing cavity.

In a preferred technical solution of the above clothing treatment agent dispensing assembly, the dispensing device is provided with a guide rail, the body is provided with a translation mechanism matching the guide rail, and the dispensing device is capable of translating between a retracted position and an extended position relative to the storage container through the cooperation of the guide rail and the translation mechanism.

In a preferred technical solution of the above clothing treatment agent dispensing assembly, the dispensing device further includes a trim panel, and when the dispensing device is in the retracted position, the trim panel is flush with an operation panel of the clothing treatment apparatus.

In a preferred technical solution of the above clothing treatment agent dispensing assembly, the clothing treatment agent dispensing assembly further includes an automatic ejection mechanism configured to automatically eject the dispensing device to the extended position.

In a preferred technical solution of the above clothing treatment agent dispensing assembly, a button is provided on the trim panel, and the button is configured to trigger the automatic ejection mechanism when pressed, so that the dispensing device is automatically ejected to the extended position.

In a preferred technical solution of the above clothing treatment agent dispensing assembly, the clothing treatment agent dispensing assembly further includes a locking mechanism which includes a locking hook disposed on the dispensing device or the body and a buckle correspondingly disposed on the body or the dispensing device, and when the dispensing device is in the retracted position, the locking hook engages with the buckle to lock the dispensing device in the retracted position.

In a preferred technical solution of the above clothing treatment agent dispensing assembly, the automatic ejection mechanism includes an elastic reset member, one end of which is connected to the body or the storage container, and the other end of which is connected to the dispensing device; and when the dispensing device is in the retracted position, the elastic reset member biases the dispensing device in a direction away from the storage container.

In a preferred technical solution of the above clothing treatment agent dispensing assembly, the clothing treatment agent dispensing assembly further includes a pumping device, which is in communication with the storage container and configured to pump the clothing treatment agent in the storage container to a working chamber of the clothing treatment apparatus.

Those skilled in the art can understand that in the preferred technical solutions of the second embodiment of the present disclosure, the clothing treatment agent dispensing assembly includes the dispensing device and the storage container, and the insertion connection device can communicate the dispensing device with the storage container when the dispensing device moves to the extended position relative to the storage container, so that when the clothing treatment agent is injected into the dispensing device, the clothing treatment agent can be delivered to the storage container through the insertion connection device; as compared with the related art, the present disclosure solves the problem of inconvenient operation of the user through a split-type design of the clothing treatment agent dispensing assembly. In addition, when the dispensing device has not moved to the extended position relative to the storage container, the dispensing device and the storage container will not communicate with each other, that is, there is no additional connecting member between the dispensing device and the storage container, which ensures that the dispensing device will not be hindered in the process of movement. Only when the dispensing device moves to the extended position relative to the storage container will the dispensing device and the storage container communicate with each other, thereby ensuring that the dispensing operation is smoothly performed. With these arrangements, the user's operations may be facilitated and the user experience may be improved.

Further, each insertion connection component can connect one dispensing cavity to the storage container; that is, in practical applications, different clothing treatment agents may be injected into different dispensing cavities, then delivered to the storage container through the corresponding insertion connection components, and finally mixed to prepare for normal washing of the clothing treatment apparatus.

Still further, the first flow channel member and the second flow channel member enable the dispensing device and the storage container to be sealingly butted when the dispensing device moves to the extended position, thereby ensuring that the clothing treatment agent in the dispensing device can enter the storage container and does not leak out from the connection position between the first flow channel member and the second flow channel member, which ensures the tightness thereof. Further, through the cooperation of the insertion tube and the insertion hole, the sealingly butting effect can be further improved. Specifically, when the first flow channel member is engaged with the second flow channel member, the insertion tube will extend into the insertion hole, so that a sealing section is formed between the insertion tube and the insertion hole, thereby improving the sealing effect of the first flow channel member and the second flow channel member.

Still further, the first valve disc can seal the clothing treatment agent outlet in a normal state (i.e., when the dispensing device has not moved to the extended position), thereby ensuring that the clothing treatment agent in the dispensing device does not leak out; at the same time, the second valve disc can seal the clothing treatment agent inlet in a normal state, thereby ensuring that the clothing treatment agent in the storage container will also not leak out. When the insertion tube and the insertion hole are engaged, the insertion tube will push the second valve disc to open the clothing treatment agent inlet, and at the same time, the jacking post will push the first valve disc to open the clothing treatment agent outlet, so that the clothing treatment agent outlet and the clothing treatment agent inlet communicate with each other, thereby communicating the first flow channel member with the second flow channel member, so that the clothing treatment agent in the dispensing device can enter the storage container along the first flow channel member and the second flow channel member in sequence, thereby achieving delivering and dispensing of the clothing treatment agent. Further, the first flow channel member first extends downward and then horizontally, and the second flow channel member first extends horizontally, then downward and finally horizontally. That is, the first flow channel member and the second flow channel member form an approximate "S"-shaped flow channel from top to bottom, which facilitates the flow of the clothing treatment agent and further ensures that the clothing treatment agent in the dispensing device can smoothly enter the storage container.

Still further, the bottom wall of the body section of the second flow channel member is inclined downward in a direction away from the dispensing device, so that the clothing treatment agent flowing through the first flow channel member and the second flow channel member from the dispensing device can flow into the storage container as quickly as possible to achieve rapid injection of the clothing treatment agent.

Still further, the bottom wall of the dispensing cavity and the bottom wall of the storage container are each inclined, that is, the bottom wall of the dispensing cavity and the bottom wall of the storage container are each inclined downward and inward from the outside of the body. With such an arrangement, after the clothing treatment agent is injected into the dispensing cavity, the clothing treatment agent will flow toward the insertion connection device along the bottom wall of the dispensing cavity, and when the clothing treatment agent in the insertion connection device enters the storage container, the clothing treatment agent will also flow from the outside to the inside along the bottom wall of the storage container. These arrangements are more advantageous for the flow of the clothing treatment agent and can ensure that the dispensing operation is smoothly performed.

Still further, the guide rail and the translation mechanism enable the dispensing device to be translated between the retracted position and the extended position, that is, the dispensing device can be pulled out of the body and pushed into the body; through the cooperation of the guide rail and the translation mechanism, the dispensing device can move in a set direction, that is, the dispensing device can be guided, so it is ensured that the dispensing device can be accurately pulled and pushed into place. Further, when the trim panel is in the retracted position, it is flush with the operation panel of the clothing treatment apparatus, which can improve the overall aesthetics of the clothing treatment apparatus.

Still further, triggering the automatic ejection mechanism by the button can further improve the convenience of the user's dispensing operation, that is, the user only needs to press the button, so the automatic ejection mechanism can eject the dispensing device to the extended position, thereby facilitating the user's injection operation on the clothing treatment agent and improving the efficiency of the user's dispensing operation in this way. Further, the locking mechanism can be used to lock the dispensing device when the dispensing device is in the retracted position, so that the dispensing device will not fall out of the body, which improves the structural stability of the dispensing device and enables the trim panel to always remain flush with the operation panel of the clothing treatment apparatus, thereby ensuring the overall aesthetics of the clothing treatment apparatus.

Still further, the elastic reset member can ensure that the dispensing device is biased when the dispensing device is in the retracted position, so that when the button is pressed by the user, the dispensing device can be smoothly ejected by the elastic reset member, thereby ensuring that the dispensing operation is smoothly performed.

Still further, the clothing treatment agent in the storage container can be delivered into the working chamber of the clothing treatment apparatus through the pumping device, thereby completing the automatic dispensing of the clothing treatment agent into the working chamber, ensuring the normal operation of the washing process of the clothing treatment apparatus, and enabling the clothing to be washed clean quickly.

A third embodiment of the present disclosure is to solve the problems of inconvenient dispensing of the clothing treatment agent of existing clothing treatment apparatuses and the poor user experience caused thereby. The clothing treatment agent dispensing assembly of the present disclosure includes a pivoting mechanism, the dispensing device pivots relative to the body by means of the pivoting mechanism, and the pivoting mechanism is provided therein with a flow channel which communicates the dispensing device with the storage container.

In a preferred technical solution of the above clothing treatment agent dispensing assembly, the pivoting mechanism includes a shaft seat and a rotating shaft pivotally inserted in the shaft seat, the flow channel includes a first flow channel disposed in the shaft seat and a second flow channel disposed in the rotating shaft, the first flow channel is in communication with the storage container, and the second flow channel is in communication with the first flow channel and the dispensing device.

In a preferred technical solution of the above clothing treatment agent dispensing assembly, the dispensing device includes at least one dispensing cavity, the rotating shaft is provided therein with at least one clothing treatment agent inlet corresponding to the dispensing cavity in a one-to-one correspondence, and each clothing treatment agent inlet communicates one dispensing cavity to the second flow channel.

In a preferred technical solution of the above clothing treatment agent dispensing assembly, a sealing groove is disposed on an inner wall at both ends of the shaft seat or an outer wall at both ends of the rotating shaft, and a sealing ring is placed in the sealing groove.

In a preferred technical solution of the above clothing treatment agent dispensing assembly, the clothing treatment agent dispensing assembly further includes a communication member disposed between the shaft seat and the storage container and configured to communicate the first flow channel with the storage container.

In a preferred technical solution of the above clothing treatment agent dispensing assembly, a bottom wall of the communication member is inclined downward in a direction away from the dispensing device.

In a preferred technical solution of the above clothing treatment agent dispensing assembly, a bottom wall of the dispensing cavity is inclined downward in a direction toward the storage container, and/or a bottom wall of the storage container is inclined downward in a direction away from the dispensing device.

In a preferred technical solution of the above clothing treatment agent dispensing assembly, the clothing treatment agent includes a detergent and a softener, and the at least one dispensing cavity includes a detergent dispensing cavity and a softener dispensing cavity.

In a preferred technical solution of the above clothing treatment agent dispensing assembly, the clothing treatment agent dispensing assembly further includes an automatic ejection mechanism configured to automatically eject the dispensing device to the extended position.

In a preferred technical solution of the above clothing treatment agent dispensing assembly, the dispensing device further includes a trim panel, and when the dispensing device pivots to a closed position, the trim panel is flush with an operation panel of the clothing treatment apparatus.

In a preferred technical solution of the above clothing treatment agent dispensing assembly, a button is provided on the trim panel, and the button is configured to trigger the automatic ejection mechanism when pressed, so that the dispensing device is automatically ejected to the extended position.

In a preferred technical solution of the above clothing treatment agent dispensing assembly, the clothing treatment agent dispensing assembly further includes a locking mechanism which includes a locking hook disposed on the dispensing device or the body and a buckle correspondingly disposed on the body or the dispensing device, and when the dispensing device pivots to the closed position, the locking hook engages with the buckle to lock the dispensing device in the closed position.

In a preferred technical solution of the above clothing treatment agent dispensing assembly, the automatic ejection mechanism includes an elastic reset member, one end of which is connected to the body, and the other end of which is connected to the dispensing device; and when the dispensing device is in the closed position, the elastic reset member applies a biasing force to the dispensing device that causes the dispensing device to pivot toward an open position.

In a preferred technical solution of the above clothing treatment agent dispensing assembly, the elastic reset member is a torsion spring.

In a preferred technical solution of the above clothing treatment agent dispensing assembly, the clothing treatment agent dispensing assembly further includes a pumping device, which is in communication with the storage container and configured to pump the clothing treatment agent in the storage container to a working chamber of the clothing treatment apparatus.

Those skilled in the art can understand that in the preferred technical solutions of the third embodiment of the present disclosure, the pivoting mechanism enables the dispensing device to pivot to the extended position, so that when the clothing treatment agent is injected into the dispensing device, the clothing treatment agent can be delivered to the storage container through the flow channel in the pivoting mechanism. As compared with the technical solution in the related art in which the dispensing device is communicated with the storage container through a connection hose, the pivoting mechanism of the present disclosure is a rigid connection component, and by communicating the dispensing device with the storage container through the flow channel in the pivoting mechanism, a blockage phenomenon is avoided when the dispensing device pivots, which would otherwise affect the delivery and injection of the clothing treatment agent; in addition, there will be no entanglement, that is, the normal movement of the dispensing device relative to the body will not be hindered. With these arrangements, the user's operations may be facilitated and the user experience may be improved.

Further, through the first flow channel and the second flow channel, the clothing treatment agent in the dispensing device can be delivered to the storage container, that is, when the dispensing device is pulled to the extended position, the user dispenses the clothing treatment agent into the dispensing device, and the clothing treatment agent in the dispensing device passes through the second flow channel in the rotating shaft and the first flow channel in the shaft seat in sequence and enter the storage container, thereby realizing the delivery and injection of the clothing treatment agent.

Still further, each clothing treatment agent inlet in the rotating shaft communicates one dispensing cavity to the second flow channel; that is, in practical applications, different clothing treatment agents may be injected into different dispensing cavities, then injected into the second flow channel through the corresponding clothing treatment agent inlets, then delivered to the storage container through the second flow channel and the first flow channel and finally mixed to prepare for normal washing of the clothing treatment apparatus.

Still further, the rotating shaft and the shaft seat can be sealed by the sealing ring between the rotating shaft and the shaft seat, so that the clothing treatment agent does not leak out from the gap between the rotating shaft and the shaft seat, thus ensuring the tightness thereof; moreover, in order to ensure the smooth pivoting of the rotating shaft relative to the shaft seat, the sealing ring may be disposed in the sealing groove of the shaft seat and/or the sealing groove of the rotating shaft, so that the sealing ring can be stably disposed in the sealing groove when the rotating shaft pivots relative to the shaft seat. As such, the smooth pivoting of the rotating shaft will not be affected while ensuring the sealing effect.

Still further, the first flow channel can be communicated to the storage container through the communication member, so that the clothing treatment agent in the dispensing device can smoothly enter the storage container. Further, the bottom wall of the communication member is inclined downward in a direction away from the dispensing device, so that the clothing treatment agent flowing from the dispensing device into the communication member can flow more smoothly into the storage container along the bottom wall of the communication member.

Still further, the bottom wall of the dispensing cavity and the bottom wall of the storage container are each inclined, that is, the bottom wall of the dispensing cavity and the bottom wall of the storage container are each inclined downward and inward from the outside of the body. With such an arrangement, after the clothing treatment agent is injected into the dispensing cavity, the clothing treatment agent will flow toward the pivoting mechanism along the bottom wall of the dispensing cavity, and when the clothing treatment agent in the pivoting mechanism enters the storage container, the clothing treatment agent will also flow from the outside to the inside along the bottom wall of the storage container. These arrangements are more advantageous for the flow of the clothing treatment agent and can ensure that the dispensing operation is smoothly performed.

Still further, triggering the automatic ejection mechanism by the button can further improve the convenience of the user's dispensing operation, that is, the user only needs to press the button, so the automatic ejection mechanism can eject the dispensing device to the extended position, thereby facilitating the user's injection operation on the clothing treatment agent and improving the efficiency of the user's dispensing operation in this way. Further, the locking mechanism can be used to lock the dispensing device when the dispensing device is in the closed position, so that the dispensing device will not fall out of the body, which improves the structural stability of the dispensing device and enables the trim panel to always remain flush with the operation panel of the clothing treatment apparatus, thereby ensuring the overall aesthetics of the clothing treatment apparatus.

Still further, the elastic reset member can ensure that the dispensing device is biased when the dispensing device is in the closed position, so that when the button is pressed by the user, the dispensing device can be smoothly ejected by the elastic reset member, thereby ensuring that the dispensing operation is smoothly performed.

Still further, the clothing treatment agent in the storage container can be delivered into the working chamber of the clothing treatment apparatus through the pumping device, thereby completing the automatic dispensing of the clothing treatment agent into the working chamber, ensuring the normal operation of the washing process of the clothing treatment apparatus, and enabling the clothing to be washed clean quickly.

A fourth embodiment of the present disclosure is to solve the problems of inconvenient dispensing of the clothing treatment agent of existing clothing treatment apparatuses and the poor user experience caused thereby. The clothing treatment agent dispensing assembly of the present disclosure includes a vertical pivoting mechanism, the dispensing device pivots relative to the body by means of the vertical pivoting mechanism around a vertical axis, and the vertical pivoting mechanism is provided therein with a flow channel which communicates the dispensing device with the storage container.

In a preferred technical solution of the above clothing treatment agent dispensing assembly, the vertical pivoting mechanism includes a shaft seat and a rotating shaft pivotally inserted in the shaft seat, and the flow channel is disposed in the rotating shaft.

In a preferred technical solution of the above clothing treatment agent dispensing assembly, the dispensing device includes at least one dispensing cavity, the rotating shaft is provided therein with at least one flow guide tube corresponding to the dispensing cavity in a one-to-one correspondence, and each flow guide tube communicates one dispensing cavity to the storage container.

In a preferred technical solution of the above clothing treatment agent dispensing assembly, a sealing groove is disposed on an inner wall of the shaft seat or an outer wall of the rotating shaft, and a sealing ring is placed in the sealing groove.

In a preferred technical solution of the above clothing treatment agent dispensing assembly, the clothing treatment agent dispensing assembly further includes a communication member disposed between the shaft seat and the storage container and including at least one flow guide channel corresponding to the flow guide tube in a one-to-one correspondence, and each flow guide channel is configured to connect one flow guide tube to the storage container.

In a preferred technical solution of the above clothing treatment agent dispensing assembly, the clothing treatment agent includes a detergent and a softener, and the at least one dispensing cavity includes a detergent dispensing cavity and a softener dispensing cavity.

In a preferred technical solution of the above clothing treatment agent dispensing assembly, the flow guide tube includes a first flow guide tube and a second flow guide tube.

In a preferred technical solution of the above clothing treatment agent dispensing assembly, the flow guide channel includes a bottom flow guide channel and a top flow guide channel, the first flow guide tube is in communication with the top flow guide channel, and the second flow guide tube is in communication with the bottom flow guide channel.

In a preferred technical solution of the above clothing treatment agent dispensing assembly, a rotation axis of the rotating shaft and a rotation axis of the second flow guide tube coincide with each other.

In a preferred technical solution of the above clothing treatment agent dispensing assembly, a bottom wall of the flow guide channel is inclined downward in a direction away from the dispensing device.

In a preferred technical solution of the above clothing treatment agent dispensing assembly, a bottom wall of the dispensing cavity is inclined downward in a direction toward the storage container, and/or a bottom wall of the storage container is inclined downward in a direction away from the dispensing device.

In a preferred technical solution of the above clothing treatment agent dispensing assembly, an inner side of the dispensing device is set to have an arc shape to facilitate pivoting outward from the body.

In a preferred technical solution of the above clothing treatment agent dispensing assembly, the clothing treatment agent dispensing assembly further includes an automatic ejection mechanism configured to automatically eject the dispensing device to an extended position.

In a preferred technical solution of the above clothing treatment agent dispensing assembly, the dispensing device further includes a trim panel, and when the dispensing device pivots to a closed position, the trim panel is flush with an operation panel of the clothing treatment apparatus.

In a preferred technical solution of the above clothing treatment agent dispensing assembly, a button is provided on the trim panel, and the button is configured to trigger the automatic ejection mechanism when pressed, so that the dispensing device is automatically ejected to an open position.

In a preferred technical solution of the above clothing treatment agent dispensing assembly, the clothing treatment agent dispensing assembly further includes a locking mechanism which includes a locking hook disposed on the dispensing device or the body and a buckle correspondingly disposed on the body or the dispensing device, and when the dispensing device pivots to a closed position, the locking hook engages with the buckle to lock the dispensing device in the closed position.

In a preferred technical solution of the above clothing treatment agent dispensing assembly, the automatic ejection mechanism includes an elastic reset member, one end of which is connected to the body, and the other end of which is connected to the dispensing device; and when the dispensing device is in a closed position, the elastic reset member applies a biasing force to the dispensing device that causes the dispensing device to pivot toward an open position.

In a preferred technical solution of the above clothing treatment agent dispensing assembly, the elastic reset member is a torsion spring.

In a preferred technical solution of the above clothing treatment agent dispensing assembly, the clothing treatment agent dispensing assembly further includes a pumping device, which is in communication with the storage container and configured to pump the clothing treatment agent in the storage container to a working chamber of the clothing treatment apparatus.

Those skilled in the art can understand that in the preferred technical solutions of the fourth embodiment of the present disclosure, the vertical pivoting mechanism enables the dispensing device to pivot to the extended position, so that when the clothing treatment agent is injected into the dispensing device, the clothing treatment agent can be delivered to the storage container through the flow channel in the vertical pivoting mechanism. As compared with the technical solution in the related art in which the dispensing device is communicated with the storage container through a connection hose, the vertical pivoting mechanism of the present disclosure is a rigid connection component, and by communicating the dispensing device with the storage container through the flow channel in the vertical pivoting mechanism, a blockage phenomenon is avoided when the dispensing device pivots, which would otherwise affect the delivery and injection of the clothing treatment agent; in addition, there will be no entanglement, that is, the normal movement of the dispensing device relative to the body will not be hindered. With these arrangements, the user's operations may be facilitated and the user experience may be improved Further, each flow guide tube in the rotating shaft communicates one dispensing cavity to the storage container; that is, in practical applications, different clothing treatment agents may be injected into different dispensing cavities, then injected into the storage container through the corresponding flow guide tubes and finally mixed to prepare for normal washing of the clothing treatment apparatus.

Further, the rotating shaft and the shaft seat can be sealed by the sealing ring between the rotating shaft and the shaft seat, so that the clothing treatment agent does not leak out from the gap between the rotating shaft and the shaft seat, thus ensuring the tightness thereof; moreover, in order to ensure the smooth pivoting of the rotating shaft relative to the shaft seat, the sealing ring may be disposed in the sealing groove of the shaft seat and/or the sealing groove of the rotating shaft, so that the sealing ring can be stably disposed in the sealing groove when the rotating shaft pivots relative to the shaft seat. As such, the smooth pivoting of the rotating shaft will not be affected while ensuring the sealing effect.

Still further, the flow guide tube can be communicated to the storage container through the communication member, so that the clothing treatment agent in the dispensing device can smoothly enter the storage container. Specifically, the flow guide tube includes a first flow guide tube and a second flow guide tube, and the flow guide channel includes a bottom flow guide channel and a top flow guide channel, wherein the first flow guide tube is in communication with the top flow guide channel, and the second flow guide tube is in communication with the bottom flow guide channel. In practical applications, the first flow guide tube may be communicated with the detergent dispensing cavity, and the second flow guide tube may be communicated with the softener dispensing cavity, so that the detergent in the detergent dispensing cavity can enter the top flow guide channel through the first flow guide tube, and the softener in the softener dispensing cavity can enter the bottom flow guide channel through the second flow guide tube. With this arrangement, the detergent and the softener can enter the storage container through different flow guide channels respectively, and finally mixed in the storage container to prepare for normal washing of the clothing treatment apparatus.

Still further, the rotation axis of the rotating shaft and the rotation axis of the second flow guide tube coincide with each other; with such an arrangement, the dispensing device can pivot vertically with respect to the body, thereby facilitating the user to perform detergent and softener dispensing operations; during the vertical pivoting of the rotating shaft, the second flow guide tube rotates around its own axis and maintains the communication with the bottom flow guide channel, and the first flow guide tube swings relative to the second flow guide tube (i.e., the first flow guide tube rotates with the axis of the second flow guide tube as the rotation axis, and with the distance between the axis of the first flow guide tube and the axis of the second flow guide tube as the radius); while the first flow guide tube is swinging, it always maintains the communication with the top flow guide channel, so that when the dispensing device pivots vertically with respect to the body, the detergent dispensing cavity and the softener dispensing cavity can always maintain the communication with the storage container, thereby facilitating the user to perform the dispensing operations.

Still further, the bottom wall of the flow guide channel is inclined downward in a direction away from the dispensing device, so that the clothing treatment agent flowing into the flow guide channel from the dispensing device can flow more smoothly into the storage container along the bottom wall of the flow guide channel.

Still further, the bottom wall of the dispensing cavity and the bottom wall of the storage container are each inclined, that is, the bottom wall of the dispensing cavity and the bottom wall of the storage container are each inclined downward and inward from the outside of the body. With such an arrangement, after the clothing treatment agent is injected into the dispensing cavity, the clothing treatment agent will flow toward the vertical pivoting mechanism along the bottom wall of the dispensing cavity, and when the clothing treatment agent in the vertical pivoting mechanism enters the storage container, the clothing treatment agent will also flow from the outside to the inside along the bottom wall of the storage container. These arrangements are more advantageous for the flow of the clothing treatment agent and can ensure that the dispensing operation is smoothly performed.

Still further, the inner side of the dispensing device is set to have an arc shape for facilitating pivoting outward from the body. With this arrangement, the dispensing device can sufficiently avoid the body structure that interferes with it when the dispensing device is pivoting, thereby ensuring that the pivoting operation of the dispensing device will not be hindered in any way, and ensuring that the pivoting operation of the dispensing device can be smoothly performed.

Still further, triggering the automatic ejection mechanism by the button can further improve the convenience of the user's dispensing operation, that is, the user only needs to press the button, so the automatic ejection mechanism can eject the dispensing device to the extended position, thereby facilitating the user's injection operation on the clothing treatment agent and improving the efficiency of the user's dispensing operation in this way. Further, the locking mechanism can be used to lock the dispensing device when the dispensing device is in the closed position, so that the dispensing device will not fall out of the body, which improves the structural stability of the dispensing device and enables the trim panel to always remain flush with the operation panel of the clothing treatment apparatus, thereby ensuring the overall aesthetics of the clothing treatment apparatus.

Still further, the elastic reset member can ensure that the dispensing device is biased when the dispensing device is in the closed position, so that when the button is pressed by the user, the dispensing device can be smoothly ejected by the elastic reset member, thereby ensuring that the dispensing operation is smoothly performed.

Still further, the clothing treatment agent in the storage container can be delivered into the working chamber of the clothing treatment apparatus through the pumping device, thereby completing the automatic dispensing of the clothing treatment agent into the working chamber, ensuring the normal operation of the washing process of the clothing treatment apparatus, and enabling the clothing to be washed clean quickly.

In another aspect, the present disclosure also provides a clothing treatment apparatus, which includes the above-described clothing treatment agent dispensing assembly.

In a preferred technical solution of the above clothing treatment apparatus, the clothing treatment apparatus is a washing machine or an integrated washing and drying machine.

The clothing treatment apparatus further provided by the present disclosure based on the above technical solutions, due to the use of the above-described clothing treatment agent dispensing assembly, has the technical effects of the above-described clothing treatment agent dispensing assembly; as compared with the clothing treatment apparatus before improvement, the clothing treatment apparatus of the present disclosure not only has a more beautiful overall appearance, but also enables the user to dispense the clothing treatment agent more conveniently, so that the user experience is improved.

BRIEF DESCRIPTION OF THE DRAWINGS

Preferred embodiments of the present disclosure will be described below with reference to the accompanying drawings and in conjunction with a washing machine. In the drawings.

DETAILED DESCRIPTION

Figure 1:
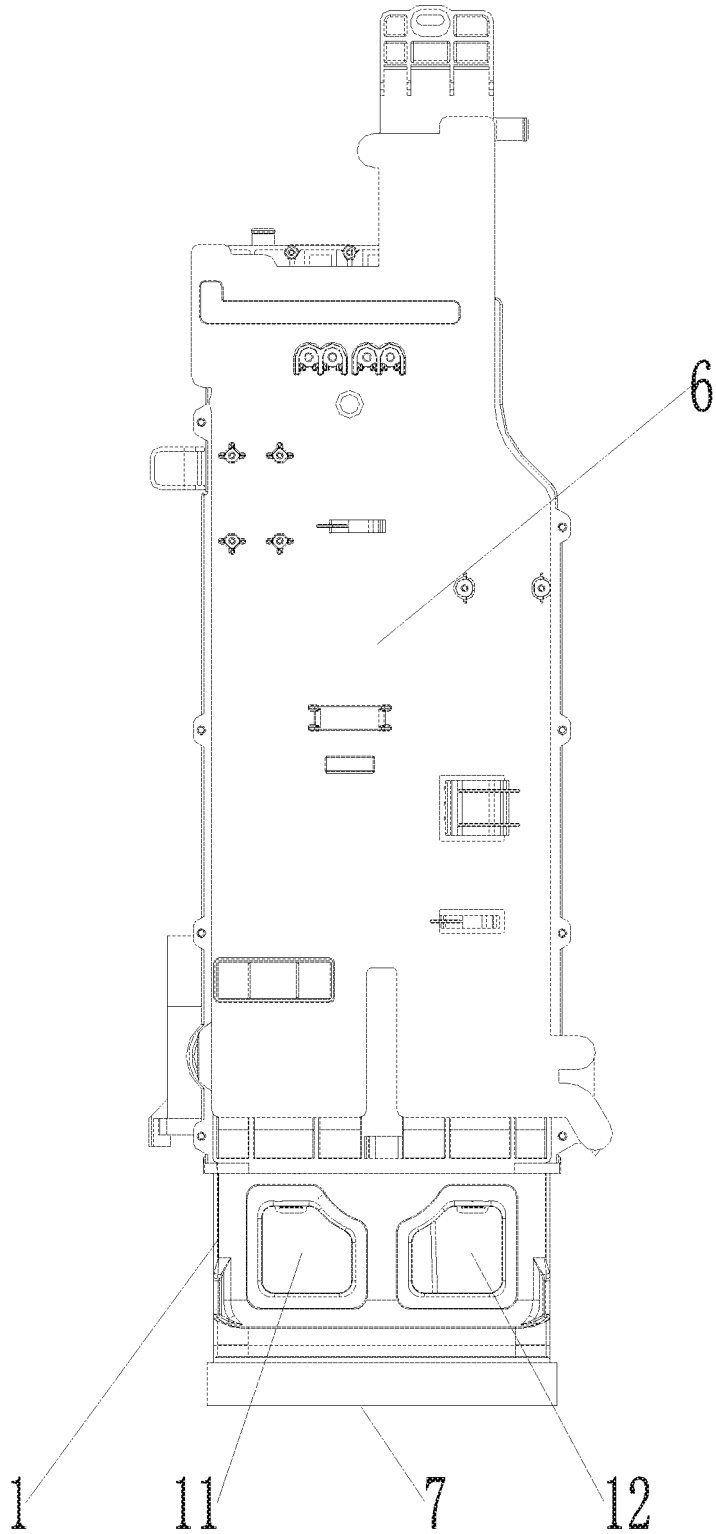
FIG. 1 is a first schematic structural view of a first embodiment of a clothing treatment agent dispensing assembly of the present disclosure.
Figure 2:
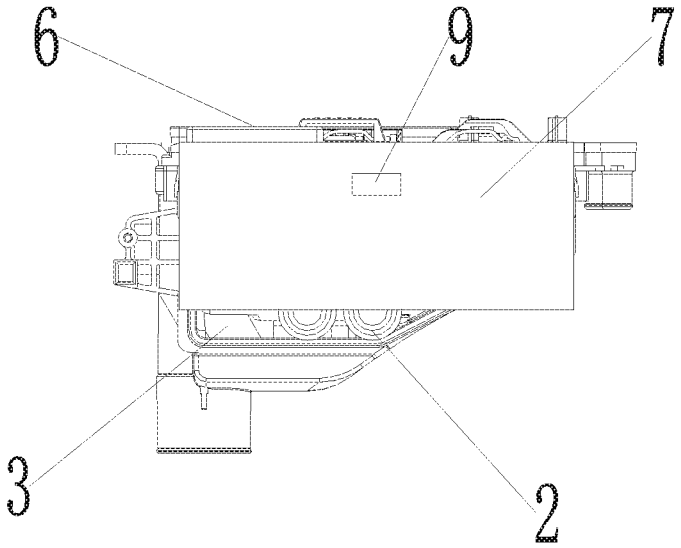
FIG. 2 is a second schematic structural view of the first embodiment of the clothing treatment agent dispensing assembly of the present disclosure.

First, it should be understood by those skilled in the art that these embodiments are only used to explain the technical principles of the present disclosure, and are not intended to limit the scope of protection of the present disclosure. For example, although the following embodiments are explained in conjunction with a washing machine, this is not limitative, and the technical solutions of the present disclosure are also applicable to other clothing treatment apparatuses, such as a shoe washer, a spin-dryer and an integrated washing and drying machine, etc. Such a change of application object does not deviate from the principle and scope of the present disclosure.

It should be noted that in the description of the present disclosure, directional or positional relationships indicated by terms such as "in", "on", "under", "front", "rear", "horizontal", "inner" and "outer" are based on the directions or positional relationships shown in the drawings. They are merely used for the convenience of description, and do not indicate or imply that the device or element involved must have a specific orientation, or be configured or operated in a specific orientation, and therefore they should not be construed as limiting the present disclosure. In addition, terms "first" and "second" are only used for descriptive purposes, and should not be understood as indicating or implying relative importance.

In addition, it should also be noted that in the description of the present disclosure, unless otherwise clearly specified and defined, terms "install", "connect" and "connection" should be understood in a broad sense; for example, the connection may be a fixed connection, or may also be a detachable connection, or an integral connection; it may be a mechanical connection or an electrical connection; it may be a direct connection, or an indirect connection through an intermediate medium, or it may be an internal communication between two elements. For those skilled in the art, the specific meaning of the above terms in the present disclosure can be understood according to specific situations.

In view of the problems of inconvenient dispensing of the clothing treatment agent of existing clothing treatment apparatuses and the poor user experience caused thereby, as pointed out in the "background of the invention", the present disclosure provides a clothing treatment agent dispensing assembly for a washing machine and a washing machine, and aims to make it more convenient for users to perform clothing treatment agent dispensing operation, thereby improving the user experience.

Specifically, the washing machine of the present disclosure includes a body, and the clothing treatment agent dispensing assembly includes a storage container and a dispensing device that are connected, wherein the storage container is fixedly disposed in the body and configured to store a clothing treatment agent, and the dispensing device is capable of moving relative to the storage container and is configured to dispense the clothing treatment agent.

First Embodiment

The clothing treatment agent dispensing assembly of the present disclosure further includes a sleeve device, one end of which is in communication with the dispensing device and the other end of which is in communication with the storage container, so that while the dispensing device is capable of moving relative to the storage container, the clothing treatment agent in the dispensing device can also flow into the storage container. The dispensing device may be a dispensing box, a dispensing board or a dispensing rack, etc., and those skilled in the art can flexibly set the specific structure of the dispensing device in practical applications, as long as the dispensing device can deliver the clothing treatment agent to the storage container through the sleeve device. In addition, the clothing treatment agent includes a detergent, a softener, etc., and those skilled in the art can flexibly set the category and specific type of the clothing treatment agent in practical applications, as long as the clothing treatment agent can be used to wash the clothing.

Preferably, as shown in FIGS. 1 to 5, the dispensing device 1 includes at least one dispensing cavity, the sleeve device includes at least one sleeve group 2 corresponding to the dispensing cavity in a one-to-one correspondence, and each sleeve group 2 communicates one dispensing cavity to the storage container 3. The number of the dispensing cavity may be one or more than one. Those skilled in the art can flexibly set the specific number of the dispensing cavity in practical applications, as long as the clothing treating agent can be dispensed into the storage container 3 through the dispensing cavity. In a possible situation, the number of the dispensing cavity is one, that is, the detergent can be first dispensed into the dispensing cavity, and then the detergent is delivered, by the sleeve group 2 connected to the dispensing cavity, to the storage container 3 for storage. In another possible situation, as shown in FIGS. 1 to 5, the number of the dispensing cavity is two, i.e., a detergent dispensing cavity 11 and a softener dispensing cavity 12 respectively, wherein the detergent dispensing cavity 11 has a detergent dispensing port, and the softener dispensing cavity 12 has a softener dispensing port. The detergent dispensing cavity 11 can deliver the detergent to the storage container 3 through the sleeve group 2 connected to the detergent dispensing cavity 11, and the softener dispensing cavity 12 can deliver the softener to the storage container 3 through the sleeve group 2 connected to the softener dispensing cavity 12; that is, the detergent and the softener are first dispensed respectively, and then mixed and stored in the storage cavity, so that the washing machine can prepare for washing of the clothing.

Figure 3:
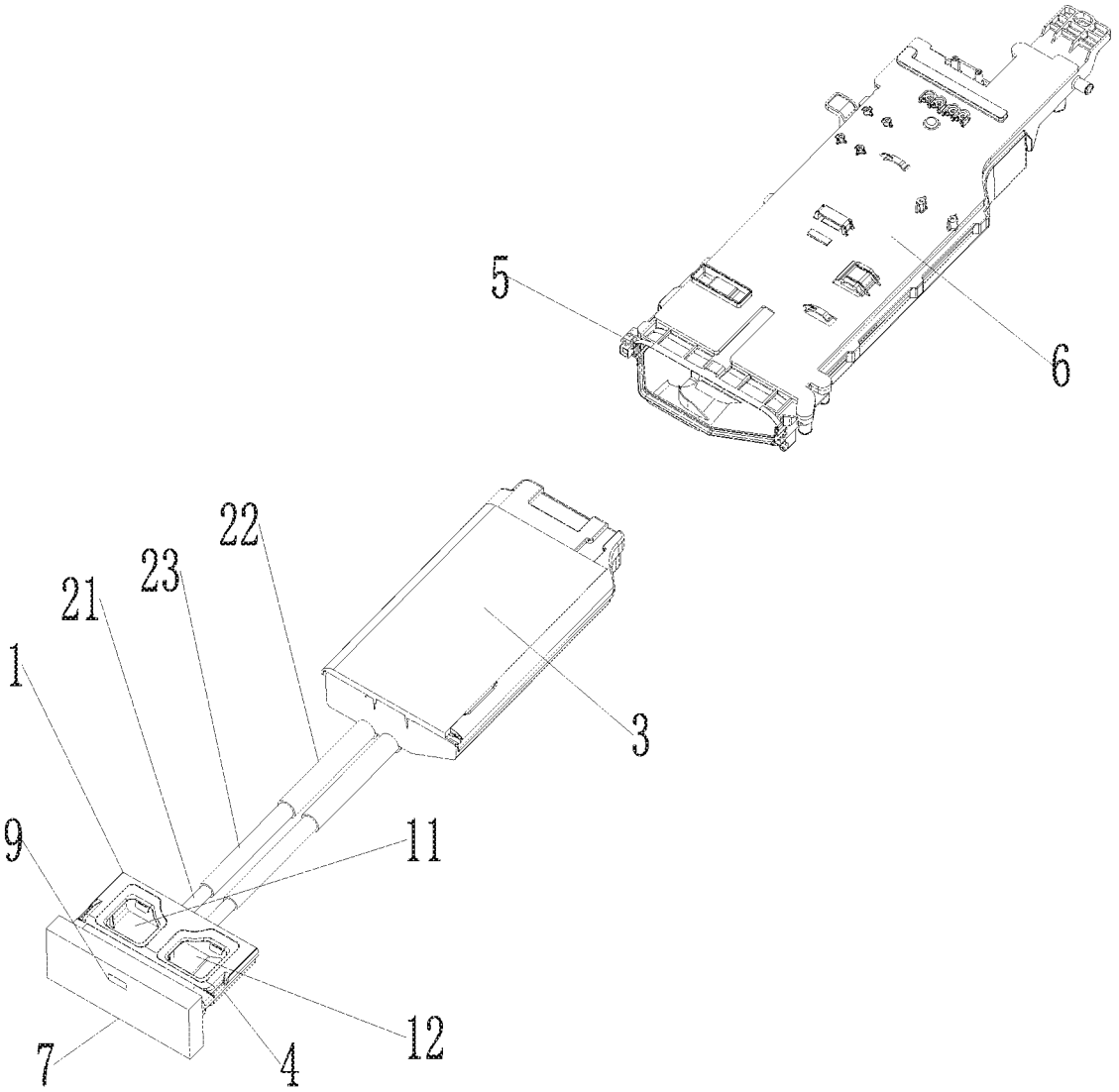
FIG. 3 is a third schematic structural view of the first embodiment of the clothing treatment agent dispensing assembly of the present disclosure.
Figure 4:
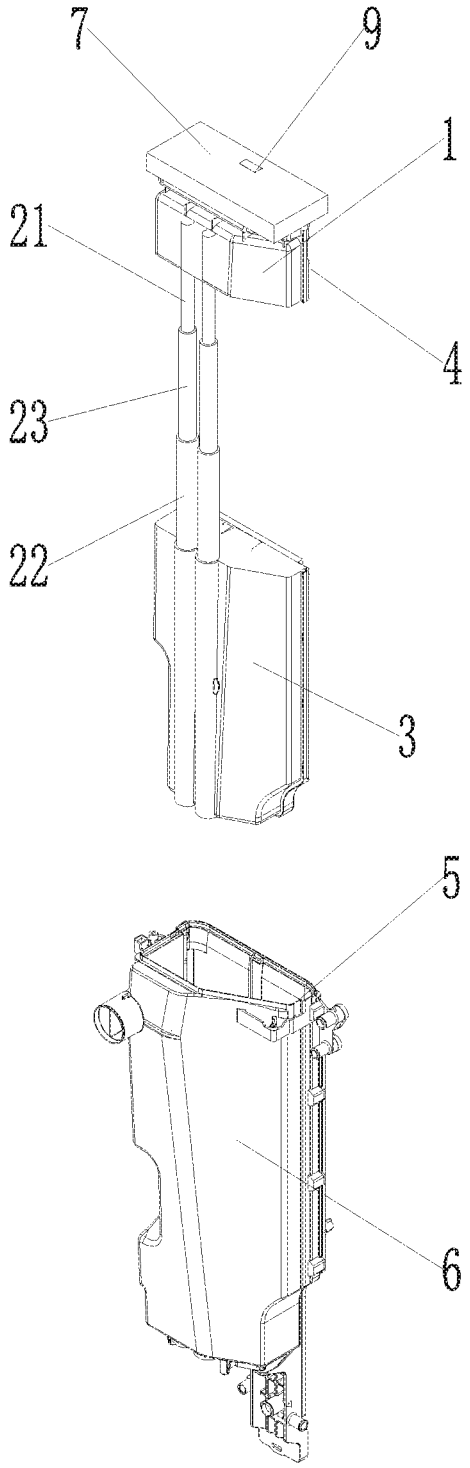
FIG. 4 is a fourth schematic structural view of the first embodiment of the clothing treatment agent dispensing assembly of the present disclosure.
Figure 5:
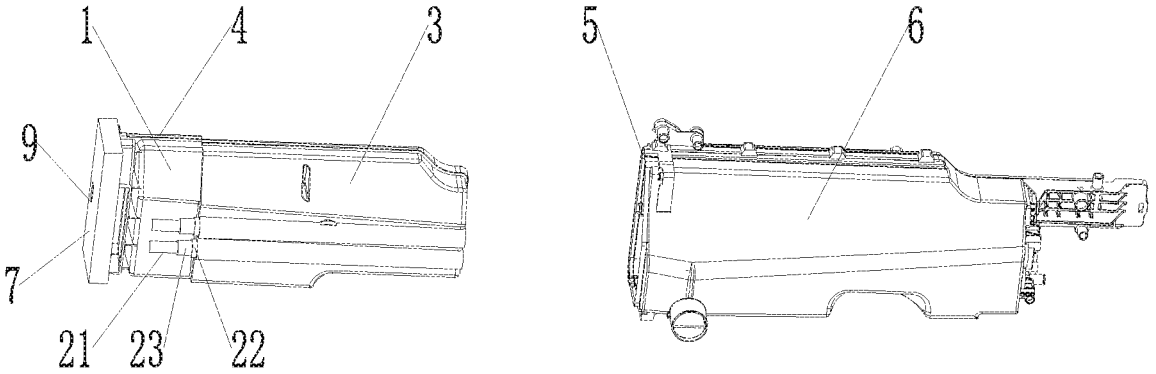
FIG. 5 is a fifth schematic structural view of the first embodiment of the clothing treatment agent dispensing assembly of the present disclosure.
Figure 6:
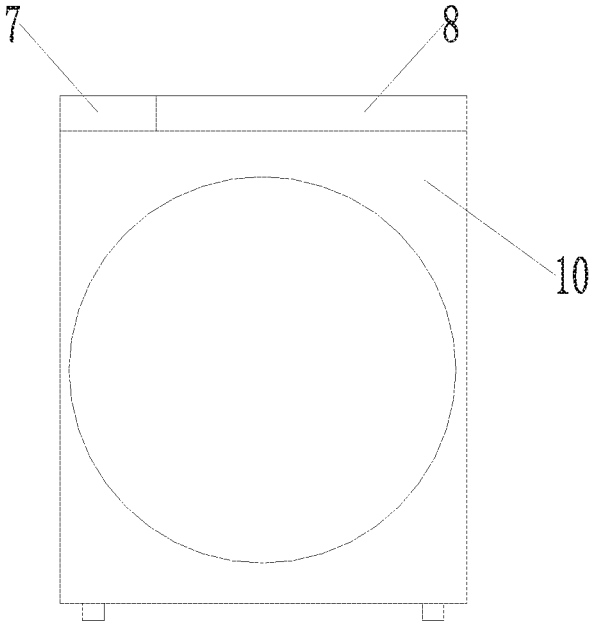
FIG. 6 is a schematic structural view of a first embodiment of a washing machine of the present disclosure.
Figure 7:
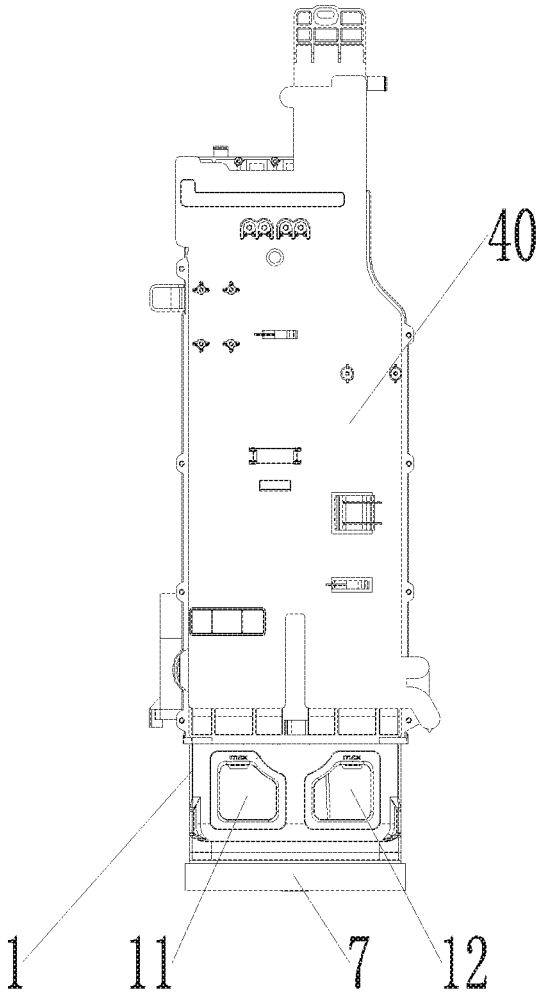
FIG. 7 is a first schematic structural view of a second embodiment of the clothing treatment agent dispensing assembly of the present disclosure.
Figure 8:
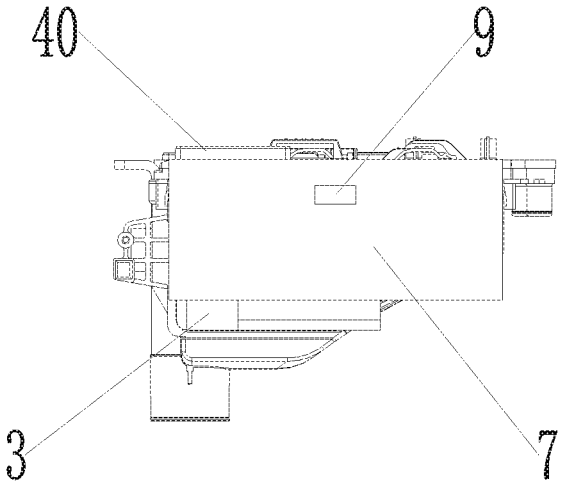
FIG. 8 is a second schematic structural view of the second embodiment of the clothing treatment agent dispensing assembly of the present disclosure.
Figure 9:
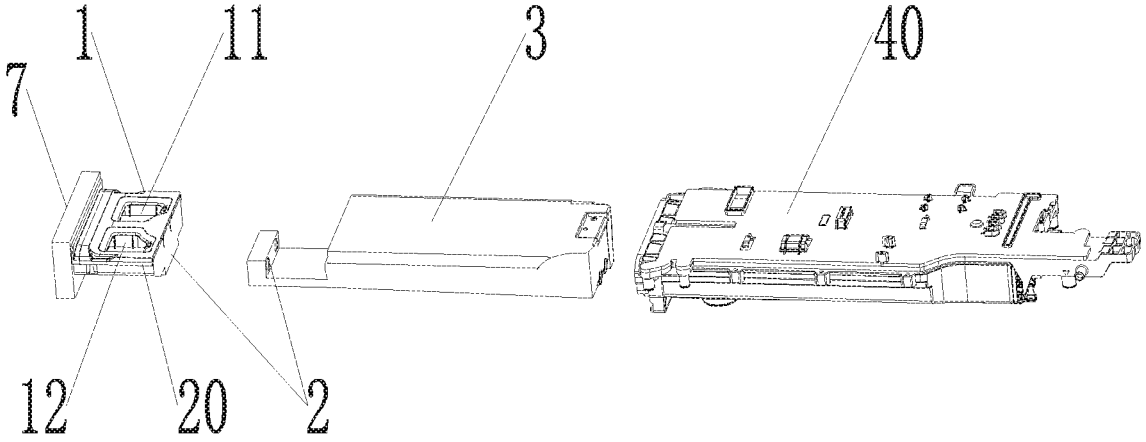
FIG. 9 is a third schematic structural view of the second embodiment of the clothing treatment agent dispensing assembly of the present disclosure.
Figure 10:
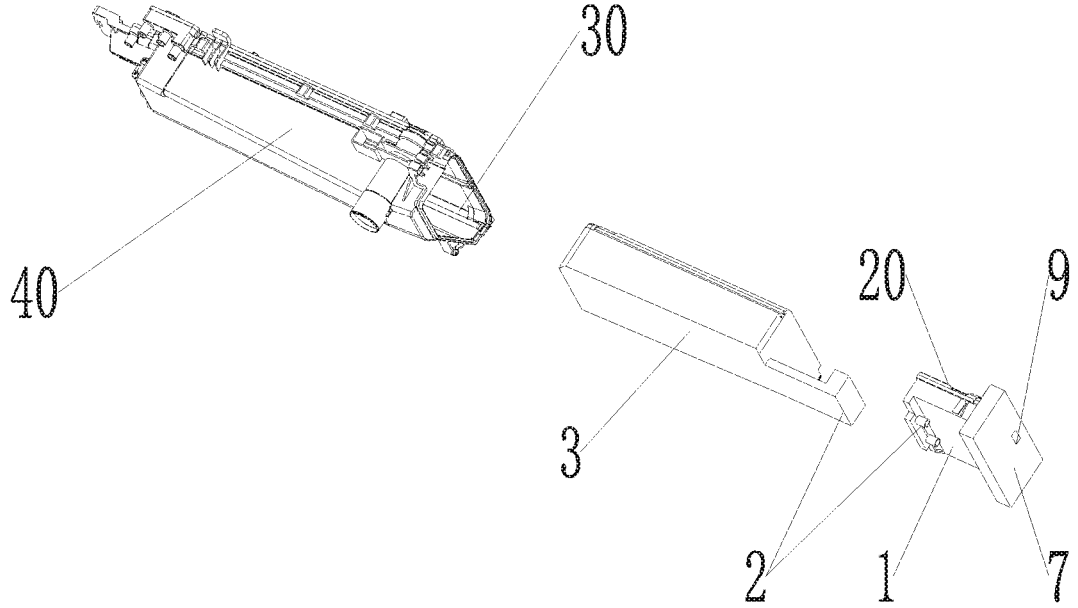
FIG. 10 is a fourth schematic structural view of the second embodiment of the clothing treatment agent dispensing assembly of the present disclosure.

Preferably, each sleeve group 2 includes a first end sleeve 21 and a second end sleeve 22, the first end sleeve 21 in communication with the dispensing cavity, the second end sleeve 22 is in communication with the storage container 3, and the first end sleeve 21 and the second end sleeve 22 are sealingly sleeved with each other. In addition, each sleeve group 2 further includes at least one intermediate sleeve 23 disposed between the first end sleeve 21 and the second end sleeve 22, and two ends of the intermediate sleeve 23 are sealingly sleeved with the first end sleeve 21 and the second end sleeve 22 respectively. Specifically, as shown in FIGS. 3 to 5, each sleeve group 2 has an intermediate sleeve 23, wherein one end of the intermediate sleeve 23 is in sealed communication with the first end sleeve 21, and the other end of the intermediate sleeve 23 is in sealed communication with the second end sleeve 22. The intermediate sleeve 23 is sleeved and connected with the first end sleeve 21 and the second end sleeve 22, so that the sleeve group 2 formed by the first end sleeve 21, the intermediate sleeve 23 and the second end sleeves 22 connected sequentially is freely telescopic, whereby when the dispensing cavity moves relative to the storage container 3, the sleeve group 2 can be adaptively adjusted in a freely telescopic manner with the movement of the dispensing cavity so as to meet the injection requirements on the clothing treatment agent. Referring to FIGS. 3 to 5, the detergent dispensing cavity 11 communicates with the storage container 3 through one sleeve group 2, and the softener dispensing cavity 12 communicates with the storage container 3 through one sleeve group 2. When the dispensing device 1 moves relative to the storage container 3, the sleeve group 2 connected between the detergent dispensing cavity 11 and the storage container 3 and the sleeve group 2 connected between the softener dispensing cavity 12 and the storage container 3 simultaneously expand and contract, so that the dispensing device 1 can move freely with the pull and push of the user. It should be noted that the above example in which one intermediate sleeve 23 is contained in each sleeve group 2 is only illustrative. In practical applications, those skilled in the art can flexibly adjust the number of the intermediate sleeve 23 according to the actual conditions of use. For example, when the maximum moving distance of the dispensing device 1 relative to the storage container 3 is small, the intermediate sleeve 23 can be omitted, and the expansion and contraction of the sleeve group 2 is completed only by the sleeving of the first end sleeve 21 and the second end sleeve 22; and when the maximum moving distance of the dispensing device 1 relative to the storage container 3 is large, the number of the intermediate sleeve 23 can be appropriately increased to meet the expansion and contraction requirements of the sleeve group 2. In addition, the length of the first end sleeve 21, the length of the intermediate sleeve 23, and the length of the second end sleeve 22 can also be flexibly adjusted in practical applications, which will not be described in detail herein.

Preferably, a bottom wall of the dispensing cavity is inclined downward in a direction toward the storage container 3, and/or a bottom wall of the storage container 3 is inclined downward in a direction away from the dispensing device 1. Specifically, as shown in FIGS. 1 to 6, the bottom wall of the detergent dispensing cavity 11 and the bottom wall of the softener dispensing cavity 12 may each be inclined downward in a direction from the outside to the inside of the body 10, and at the same time, the bottom wall of the storage container 3 may also be correspondingly disposed to be inclined downward in a direction from the outside to the inside of the body 10, so as to facilitate a smooth flow of the detergent and the softener. Of course, in practical applications, the bottom wall of the storage container 3 may also be disposed horizontally. Such changes to the bottom wall of the storage container 3 do not deviate from the principle and scope of the present disclosure, and all belong to the scope of protection of the present disclosure. More preferably, the first end sleeve 21 is connected to the bottom of a rear side wall of the dispensing cavity, and the second end sleeve 22 is connected to the top of a front side wall of the storage container 3. Specifically, each of the bottom of the detergent dispensing cavity 11 and the bottom of the softener dispensing cavity 12 is connected with one first end sleeve 21 respectively, and the corresponding second end sleeves 22 are connected to the top of the storage container 3, thereby facilitating dispensing of the detergent and the softener. Of course, in practical applications, the first end sleeve 21 may also be connected to other positions of the detergent dispensing cavity 11 and the softener dispensing cavity 12; similarly, the second end sleeve 22 may also be connected to other positions of the storage container 3, and those skilled in the art can flexibly set the specific connection positions of the first end sleeve 21 and the second end sleeve 22 in practical applications, as long as the connection between the first end sleeve 21 and the dispensing cavity as well as the connection between the second end sleeve 22 and the storage container 3 can ensure that the clothing treatment agent in the dispensing cavity can be injected into the storage container 3.

Preferably, the dispensing device 1 is provided with a guide rail 4, the body 10 is provided with a translation mechanism matching the guide rail 4, and the dispensing device 1 is capable of translating between a retracted position and an extended position relative to the storage container 3 through the cooperation of the guide rail 4 and the translation mechanism. As shown in FIGS. 1 to 6, the translation mechanism may be a track groove 5 that cooperates with the guide rail 4, and through the cooperation of the guide rail 4 and the track groove 5, the directional movement of the dispensing device 1 relative to the storage container 3 is achieved. In addition, in order that the storage container 3 can be fixed in the body 10, an accommodation cavity 6 for accommodating the storage container 3 and the dispensing device 1 may be provided in the body 10. The storage container 3 is fixed at the rear part of the accommodation cavity 6, and the track groove 5 is disposed on an inner side wall at the front part of the accommodation cavity 6. The guide rail 4 and the track groove 5 enable the dispensing device 1 to be received at the front part of the accommodation cavity 6. Of course, the above translation mechanism may also be a sliding protrusion or a slide rail, etc. Those skilled in the art can flexibly set the specific structure of the translation mechanism in practical applications, as long as the dispensing device 1 can be pulled out of the body 10 and pushed into the body 10 through the cooperation of the guide rail 4 and the translation mechanism.

Preferably, the dispensing device 1 further includes a trim panel 7, and when the dispensing device 1 is in the retracted position, the trim panel 7 is flush with an operation panel 8 of the washing machine. As shown in FIGS. 1 to 6, when the dispensing device 1 is completely received in the body 10, an outer side surface of the trim panel 7 is flush with an outer side surface of the operation panel 8 of the washing machine, that is, the outer side surface of the trim panel 7 and the outer side surface of the operation panel 8 are coplanar, thus making the washing machine have a more beautiful overall appearance.

Further preferably, the clothing treatment agent dispensing assembly of the present disclosure further includes an automatic ejection mechanism configured to automatically eject the dispensing device 1 to the extended position. The automatic ejection mechanism may be configured to eject the dispensing device 1 by a manual operation or by an automatic operation. If the automatic ejection mechanism is controlled by the automatic operation, the automatic ejection mechanism may be signal-connected to a control panel of the washing machine. When the control panel is operated, a signal may be sent to the automatic ejection mechanism, so that the automatic ejection mechanism operates to automatically eject the dispensing device 1 to the extended position. If the automatic eject mechanism is controlled by the manual operation, a button 9 may be provided on the trim panel 7, and the button 9 is configured to trigger the automatic ejection mechanism when pressed, so that the dispensing device 1 is automatically ejected to the extended position.

In a possible situation, the automatic ejection mechanism includes an elastic reset member, one end of which is connected to the body 10 or the storage container 3, and the other end of which is connected to the dispensing device 1; and when the dispensing device 1 is in the retracted position, the elastic reset member biases the dispensing device 1 in a direction away from the storage container 3. Specifically, the elastic reset member may be a spring, and the button 9 may selectively abut the spring through a connecting rod to control expansion and contraction of the spring. In a normal state (that is, when the dispensing device 1 is in the retracted position), the connecting rod abuts the spring, and when the button 9 cancels abutting the spring through the connecting rod, the spring releases its own elastic force and applies a thrust to the dispensing device 1, so that the dispensing device 1 is automatically ejected to the extended position; when the dispensing device 1 returns to the retracted position, the connecting rod abuts the spring again and causes the spring to bias the dispensing device 1. In order to ensure the smooth progress of the above operations, in practical applications, it is necessary to enable the dispensing device 1 to be smoothly locked when it is in the retracted position. In a preferred embodiment, the clothing treatment agent dispensing assembly of the present disclosure further includes a locking mechanism which includes a locking hook disposed on the dispensing device 1 or the body 10 and a buckle correspondingly disposed on the body 10 or the dispensing device 1, and when the dispensing device 1 is in the retracted position, the locking hook engages with the buckle to lock the dispensing device 1 in the retracted position. Specifically, a locking hook may be provided on the dispensing device 1, a buckle may be provided on the body 10 at a position corresponding to the locking hook, and the dispensing device 1 is locked to the body 10 through the cooperation of the locking hook and the buckle. Of course, it is also possible to dispose the locking hook on the body 10 and dispose the buckle on the dispensing device 1 so as to achieve the locking of the dispensing device 1 and the body 10. It should be noted that the above specific structures of the elastic reset member and the locking mechanism are only exemplary. For example, the elastic reset member may also be a torsion spring, and the locking mechanism may also be a structure in which a protrusion mates with a groove. Those skilled in the art can flexibly set the specific structures of the elastic reset member and the locking mechanism in practical applications, as long as the dispensing device 1 can be automatically ejected by the elastic reset member and the dispensing device 1 can be locked with the body 10 by the locking mechanism.

Preferably, the clothing treatment agent dispensing assembly of the present disclosure further includes a pumping device, which is in communication with the storage container 3 and configured to pump the clothing treatment agent in the storage container 3 to a working chamber of the washing machine. The pumping device may be a hydraulic pump, wherein one end of the hydraulic pump communicates with the storage container 3, and the other end communicates with the working chamber of the washing machine. The hydraulic pump is signal-connected to the control panel. The hydraulic pump can be turned on through the control panel so that the clothing treatment agent in the storage container 3 is injected into the working chamber, thereby completing the washing operation on the clothing. Of course, the above-mentioned pumping device being a hydraulic pump is only exemplary, and those skilled in the art can flexibly set the specific structure of the pumping device in practical applications, as long as a mixture of the detergent and the softener in the storage container 3 can be injected into the working chamber of the washing machine by the pumping device.

Second Embodiment

The clothing treatment agent dispensing assembly of the present disclosure further includes a communication device, which is configured to communicate the dispensing device with the storage container and allow the dispensing device to move relative to the storage container. The communication device may be an insertion connection device, a sleeving device, a telescopic device, or a flexible connection device. Those skilled in the art can flexibly set the specific structure of the communication device in practical applications, as long as the connection device can communicate the dispensing device with the storage container and does not hinder the normal movement of the dispensing device. In the present disclosure, a detailed description is given mainly using an example in which the communication device is an insertion connection device.

Specifically, the communication device of the present disclosure is provided in the form of an insertion connection device, wherein a part of the insertion connection device is disposed on the dispensing device, and another part of the insertion connection device is disposed on the storage container, so that when the dispensing device moves to the extended position relative to the storage container, the insertion connection device communicates the dispensing device with the storage container, thus enabling the clothing treatment agent in the dispensing device to flow into the storage container. The dispensing device may be a dispensing box, a dispensing board or a dispensing rack, etc., and those skilled in the art can flexibly set the specific structure of the dispensing device in practical applications, as long as the dispensing device can deliver the clothing treatment agent to the storage container through the insertion connection device. In addition, in order that the storage container can be fixed in the body, an accommodation cavity for accommodating the storage container and the dispensing device may be provided in the body. The storage container is fixed at the rear part of the accommodation cavity, and when the dispensing device moves to the retracted position, the dispensing device is received at the front part of the accommodation cavity. In addition, the clothing treatment agent includes a detergent, a softener, etc., and those skilled in the art can flexibly set the category and specific type of the clothing treatment agent in practical applications, as long as the clothing treatment agent can be used to wash the clothing.

Preferably, as shown in FIGS. 7 to 13, the dispensing device 1 includes at least one dispensing cavity, the insertion connection device includes at least one insertion connection component 2 corresponding to the dispensing cavity in a one-to-one correspondence, and each insertion connection component 2 communicates one dispensing cavity to the storage container 3. The number of the dispensing cavity may be one or more than one. Those skilled in the art can flexibly set the specific number of the dispensing cavity in practical applications, as long as the clothing treating agent can be dispensed into the storage container 3 through the dispensing cavity. In a possible situation, the number of the dispensing cavity is one, that is, the detergent can be first dispensed into the dispensing cavity, and then the detergent is delivered, by one insertion connection component 2, to the storage container 3 for storage. In another possible situation, as shown in FIGS. 7 to 13, the number of the dispensing cavity is two, i.e., a detergent dispensing cavity 11 and a softener dispensing cavity 12 respectively, wherein the detergent dispensing cavity 11 has a detergent dispensing port, and the softener dispensing cavity 12 has a softener dispensing port. The detergent dispensing cavity 11 can deliver the detergent to the storage container 3 through one insertion connection component 2, and the softener dispensing cavity 12 can deliver the softener to the storage container 3 through another insertion connection component 2; that is, the detergent and the softener are first dispensed respectively, and then mixed and stored in the storage cavity, so that the washing machine can prepare for washing of the clothing.

Figure 11:
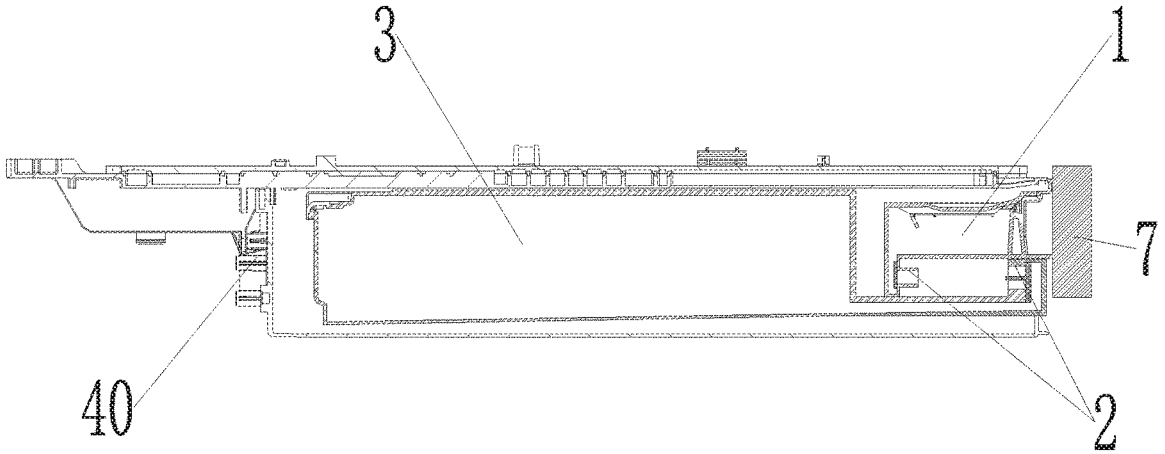
FIG. 11 is a fifth schematic structural view of the second embodiment of the clothing treatment agent dispensing assembly of the present disclosure.
Figure 12:
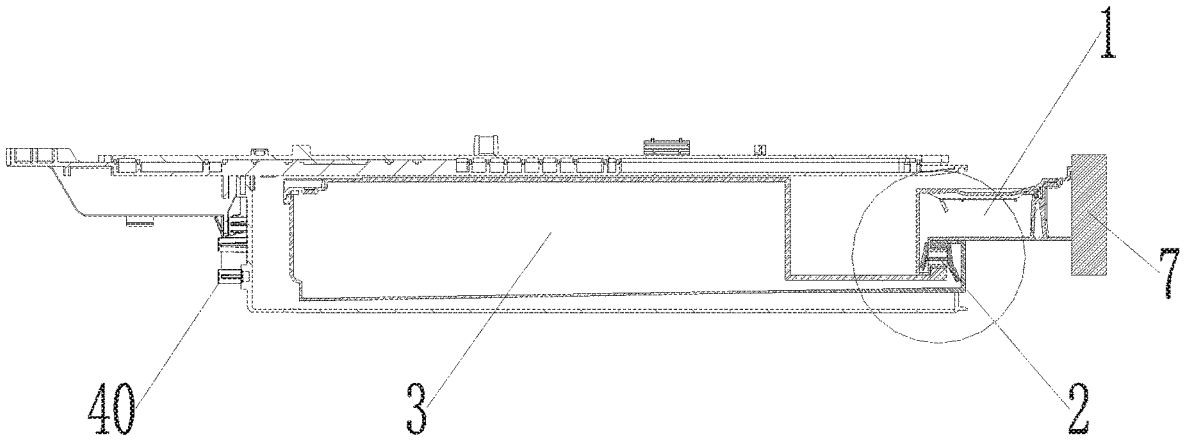
FIG. 12 is a sixth schematic structural view of the second embodiment of the clothing treatment agent dispensing assembly of the present disclosure.
Figure 13:
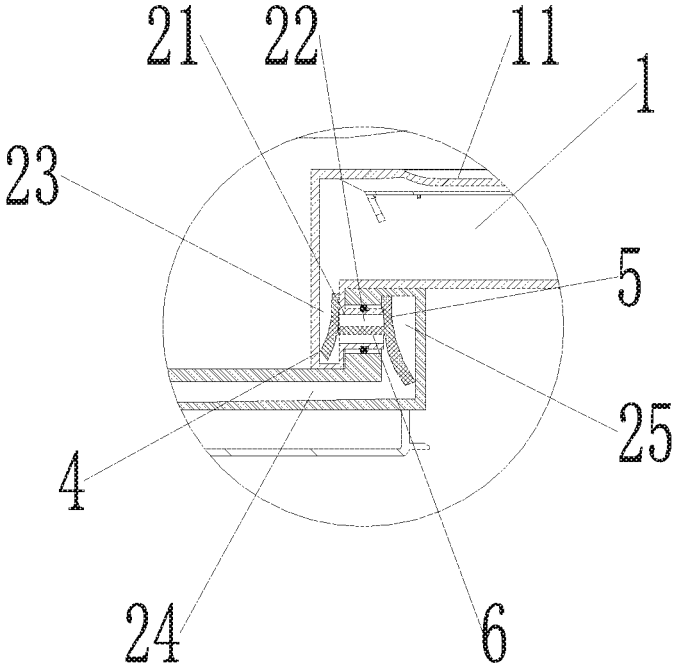
FIG. 13 is a partially enlarged view of FIG. 12.
Figure 14:
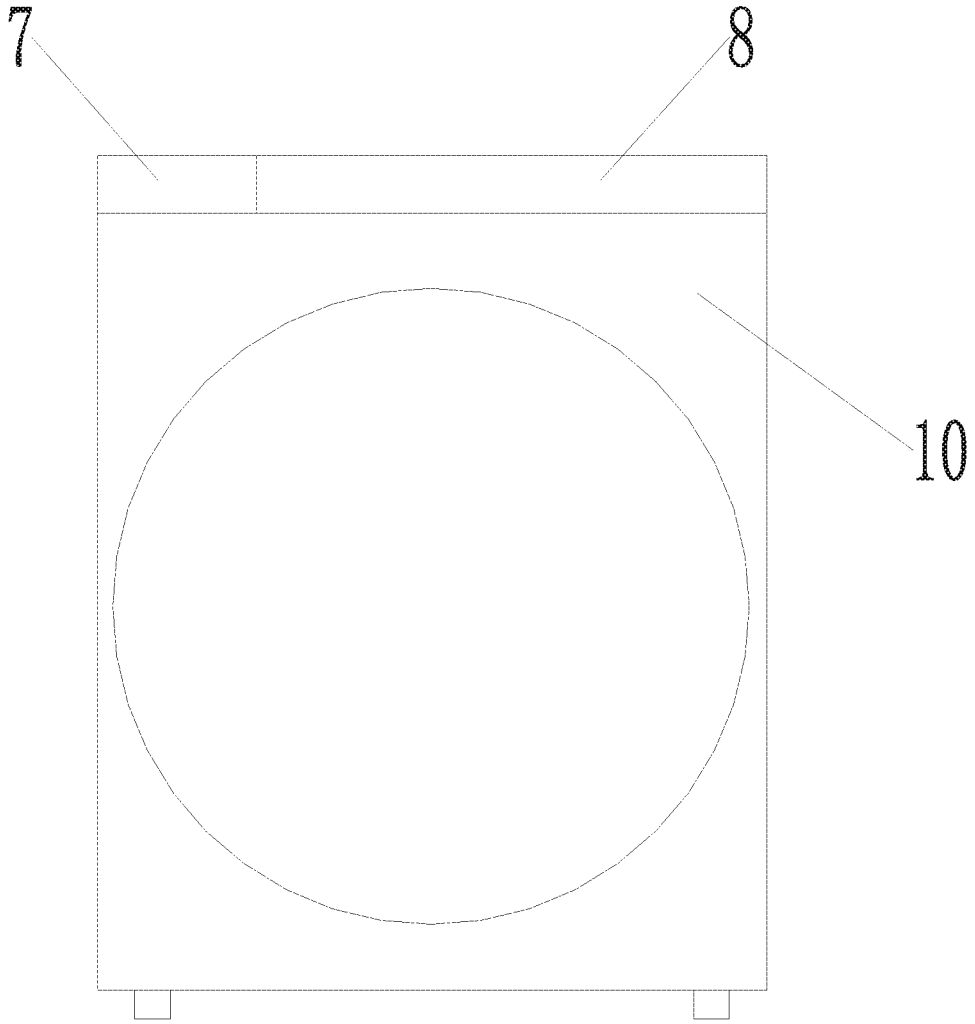
FIG. 14 is a schematic structural view of a second embodiment of the washing machine of the present disclosure.
Figure 15:
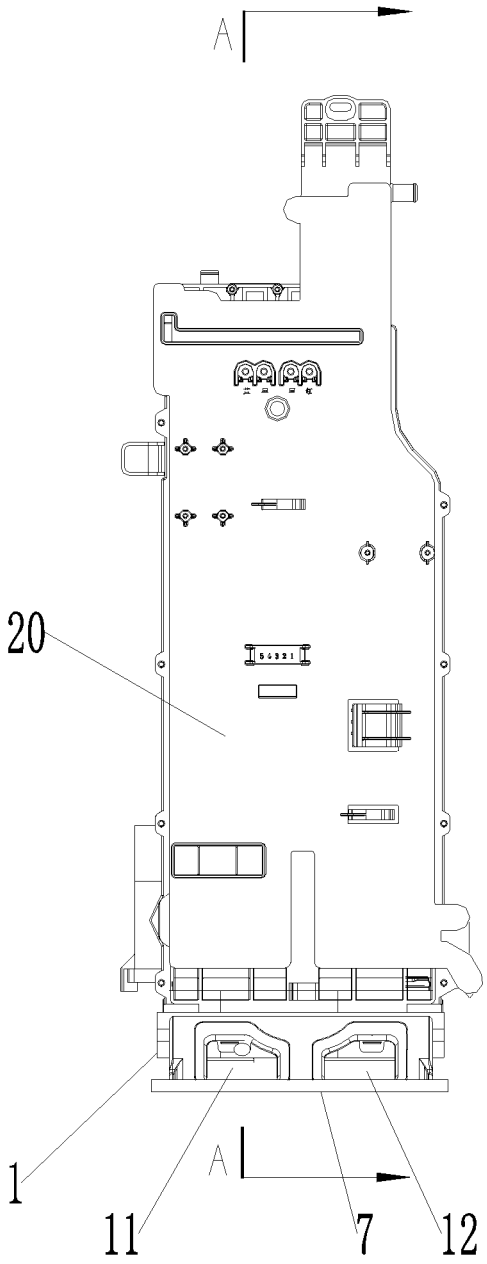
FIG. 15 is a first schematic structural view of a third embodiment of the clothing treatment agent dispensing assembly of the present disclosure.
Figure 16:
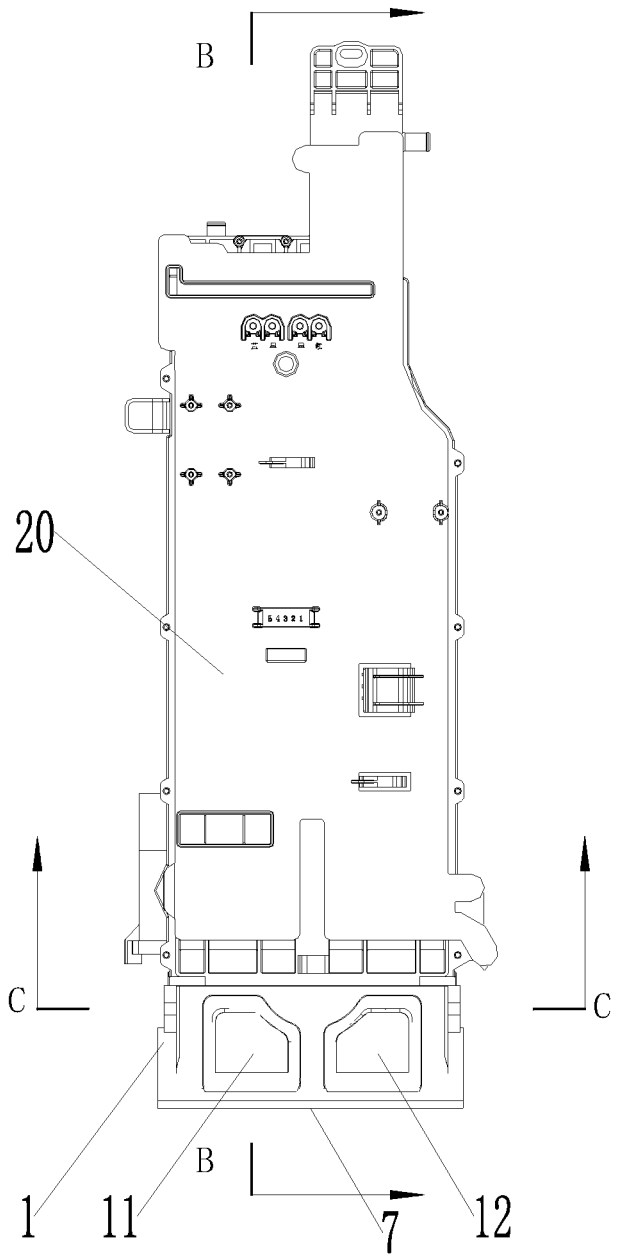
FIG. 16 is a second schematic structural view of the third embodiment of the clothing treatment agent dispensing assembly of the present disclosure.
Figure 17:
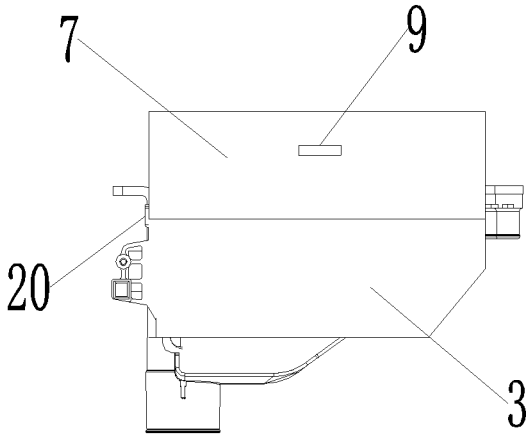
FIG. 17 is a third schematic structural view of the third embodiment of the clothing treatment agent dispensing assembly of the present disclosure.
Figure 18:
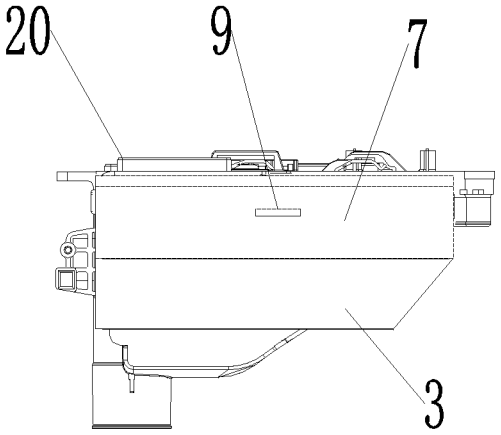
FIG. 18 is a fourth schematic structural view of the third embodiment of the clothing treatment agent dispensing assembly of the present disclosure.
Figure 19:
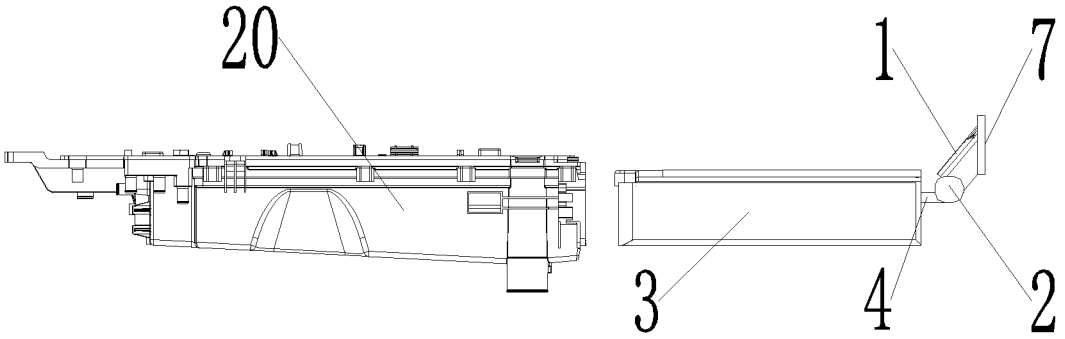
FIG. 19 is a fifth schematic structural view of the third embodiment of the clothing treatment agent dispensing assembly of the present disclosure.
Figure 20:
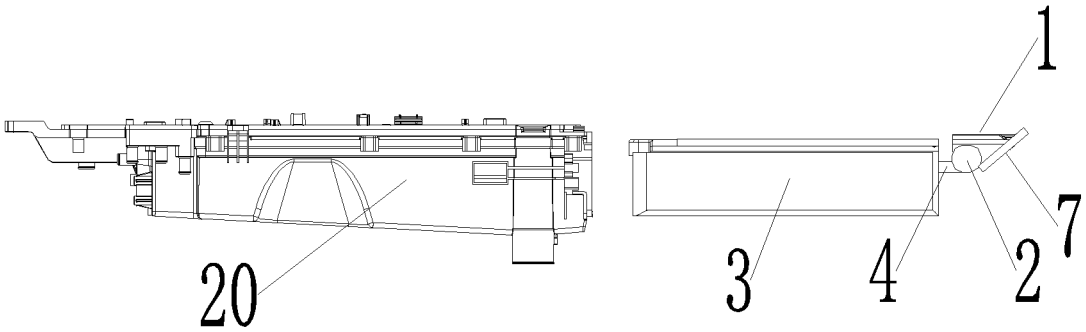
FIG. 20 is a sixth schematic structural view of the third embodiment of the clothing treatment agent dispensing assembly of the present disclosure.
Figure 21:
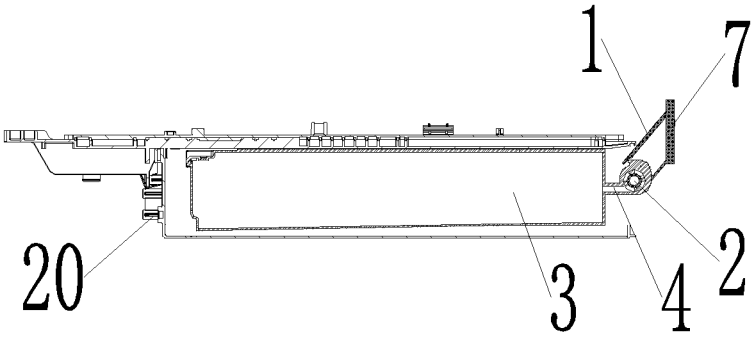
FIG. 21 is a cross-sectional view taken along line A-A in FIG. 15.
Figure 22:
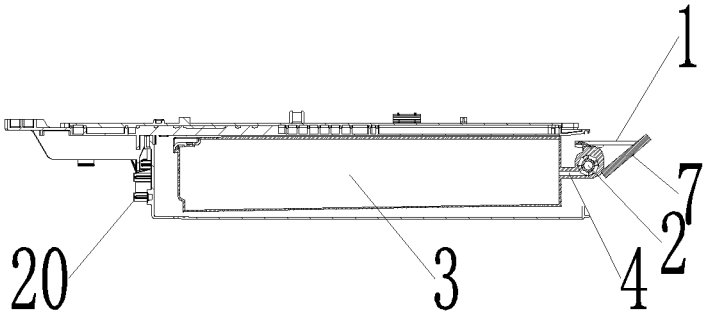
FIG. 22 is a cross-sectional view taken along line B-B in FIG. 16.

Preferably, each insertion connection component 2 includes a first flow channel member and a second flow channel member, the first flow channel member is in communication with the dispensing cavity and includes a clothing treatment agent outlet, the second channel member is in communication with the storage container 3 and includes a clothing treatment agent inlet, and when the dispensing device 1 moves to the extended position relative to the storage container 3, the clothing treatment agent outlet is sealingly butted with the clothing treatment agent inlet. In a possible embodiment, the first flow channel member is provided with an insertion tube 21 that forms the clothing treatment agent outlet, the second flow channel member is provided with an insertion hole 22 that forms the clothing treatment agent inlet, and when the dispensing device 1 moves to the extended position relative to the storage container 3, the insertion tube 21 and the insertion hole 22 are sealingly engaged. In another possible embodiment, the first flow channel member is provided with an insertion hole 22 that forms the clothing treatment agent outlet, the second flow channel member is provided with an insertion tube 21 that forms the clothing treatment agent inlet, and when the dispensing device 1 moves to the extended position relative to the storage container 3, the insertion hole 22 and the insertion tube 21 are sealingly engaged. The above two kinds of insertion holes 22 and insertion tubes 21 are engaged in a similar manner, and only the first situation will be described in detail below. Specifically, as shown in FIGS. 11 to 13, when the dispensing device 1 moves to the right and reaches the extended position, the dispensing device 1 is engaged with the storage container 3, that is, the first flow channel member and the second flow channel member are engaged with each other. At this point, the insertion tube 21 extends into the insertion hole 22, so that the detergent in the detergent dispensing cavity 11 can enter the storage container 3, and the softener in the softener dispensing cavity 12 can also enter the storage container 3, thereby achieving mixing and storage of the detergent and the softener. In practical applications, in order to ensure that the insertion tube 21 and the insertion hole 22 can be sealingly connected, a sealing ring may be provided between the insertion tube 21 and the insertion hole 22 (that is, between the outer wall of the insertion tube 21 and the inner wall of the insertion hole 22), thereby sealing the insertion tube 21 and the insertion hole 22. The sealing ring may be an O-ring or other forms of sealing ring. Those skilled in the art can flexibly set the specific type of sealing ring in practical applications, as long as the sealing ring can seal the insertion tube 21 and the insertion hole 22.

Further preferably, to ensure that the clothing treatment agent in the dispensing device 1 and the storage container 3 does not leak out when the dispensing device 1 does not reach the extended position, the clothing treatment agent outlet and the clothing treatment agent inlet need to be sealed. Specifically, as shown in FIG. 13, the insertion tube 21 is provided with a first valve disc 4, which is attached to the clothing treatment agent outlet in a normal state and thus closes the clothing treatment agent outlet; the insertion hole 22 is provided with a second valve disc 5, which is attached to the clothing treatment agent inlet in a normal state and thus closes the clothing treatment agent inlet; and the second valve disc 5 is further provided with an outwardly extending jacking post 6; wherein when the insertion tube 21 is engaged with the insertion hole 22, the insertion tube 21 pushes the second valve disc 5 and thus opens the clothing treatment agent inlet, and at the same time, the jacking post 6 pushes the first valve disc 4 and thus opens the clothing treatment agent outlet. Specifically, when the dispensing device 1 moves to the right and reaches the extended position, the dispensing cavity (taking the softener dispensing cavity 12 as an example) is engaged with the storage container 3; at this point, the insertion tube 21 moves to the right and pushes the second valve disc 5 to open the clothing treatment agent inlet; at this point, the jacking post 6 (in practical applications, the length of the jacking post 6 should be greater than the length of the insertion tube 21) will push away the first valve disc 4 accordingly to open the clothing treatment agent outlet, so that the clothing treatment agent inlet and the clothing treatment agent outlet are communicated, ensuring that the softener in the softener dispensing cavity 12 can enter the storage container 3 after sequentially passing through the clothing treatment agent outlet, the insertion tube 21, and the clothing treatment agent inlet. When the dispensing device 1 moves to the left and separates the softener dispensing cavity 12 from the storage container 3, the thrust of the insertion tube 21 on the second valve disc 5 is removed, and the thrust of the jacking post 6 on the first valve disc 4 is also removed. At this point, the first valve disc 4 will close the clothing treatment agent outlet, and the second valve disc 5 will close the clothing treatment agent inlet, so that the softener will not leak out from the clothing treatment agent outlet, and at the same time the mixture of the detergent and the softener also will not leak out from the clothing treatment agent inlet. In practical applications, the first valve disc 4 and the second valve disc 5 may be made of an elastic material, thereby ensuring that after the forces on the first valve disc 4 and the second valve disc 5 are removed, the first valve disc 4 can close the clothing treatment agent outlet by its own elastic resetting effect, and the second valve disc 5 can also close the clothing treatment agent inlet by its own elastic resetting effect.

Still further preferably, the first flow channel member includes a body portion 23 extending downward from the dispensing cavity, and the insertion tube 21 extends outward horizontally from the body portion 23 (that is, extending horizontally from left to right in FIG. 13); the second flow channel member includes a body section 24 extending outward horizontally from the storage container 3 (that is, extending horizontally from left to right in FIG. 13) and a vertical section 25 extending upward from the body section 24, and the insertion hole 22 is formed on an inner side of the vertical section 25. As shown in FIG. 13, still taking the softener dispensing cavity 12 as an example, the softener dispensing cavity 12, the first flow channel member and the second flow channel member together form a "S"-shaped flow channel, that is, the softener first moves laterally to the left, then flows downward through the body portion 23 of the first flow channel member, then flows to the right through the insertion tube 21, then flows downward through the vertical section 25 of the second flow channel member, finally flows to the left through the body section 24 of the second flow channel member and eventually enters the storage container 3. Of course, the above arrangement of the first flow channel member and the second flow channel member is only exemplary, and those skilled in the art can flexibly set the specific structures and specific flow directions of the first flow channel member and the second flow channel member in practical applications, as long as the first flow channel member and the second flow channel member enable the clothing treatment agent in the dispensing cavity to smoothly flow into the storage container 3.

It should be noted that in addition to the cooperation of the insertion tube 21 and the insertion hole 22 shown in the above embodiment, the insertion connection device of the present disclosure may also be in other forms of insertion connection, such as insertion connection of two butting tubes with different diameters. Those skilled in the art can flexibly set the specific structure of the insertion connection device in practical applications, as long as the insertion connection device can communicate the dispensing device 1 with the storage container 3 when the dispensing device 1 moves to the extended position. In addition, in order to ensure that the insertion device can be inserted into place when the dispensing device 1 moves to the extended position, a displacement sensor may be disposed on the dispensing device 1/the body 10, so that the dispensing device 1 can accurately move to the extended position and the insertion connection device is inserted into place, thus communicating the dispensing device 1 with the storage container 3 and preventing the sealed connection from failing.

Preferably, a bottom wall of the dispensing cavity is inclined downward in a direction toward the storage container 3, and/or a bottom wall of the storage container 3 is inclined downward in a direction away from the dispensing device 1. Specifically, as shown in FIGS. 7 to 14, the bottom wall of the detergent dispensing cavity 11 and the bottom wall of the softener dispensing cavity 12 may each be inclined downward in a direction from the outside to the inside of the body 10, and at the same time, the bottom wall of the storage container 3 may also be correspondingly disposed to be inclined downward in a direction from the outside to the inside of the body 10, so as to facilitate a smooth flow of the detergent and the softener. Of course, in practical applications, the bottom wall of the storage container 3 may also be disposed horizontally. Such changes to the bottom wall of the storage container 3 do not deviate from the principle and scope of the present disclosure, and all belong to the scope of protection of the present disclosure.

Preferably, the dispensing device 1 is provided with a guide rail 20, the body 10 is provided with a translation mechanism matching the guide rail 20, and the dispensing device 1 is capable of translating between a retracted position and an extended position relative to the storage container 3 through the cooperation of the guide rail 20 and the translation mechanism. As shown in FIGS. 7 to 14, the translation mechanism may be a track groove 30 that cooperates with the guide rail 20, and through the cooperation of the guide rail 20 and the track groove 30, the directional movement of the dispensing device 1 relative to the storage container 3 is achieved. In addition, in order that the storage container 3 can be fixed in the body 10, an accommodation cavity 40 for accommodating the storage container 3 and the dispensing device 1 may be provided in the body 10. The storage container 3 is fixed at the rear part of the accommodation cavity 40, and the track groove 30 is disposed on an inner side wall at the front part of the accommodation cavity 40. The guide rail 20 and the track groove 30 enable the dispensing device 1 to be received at the front part of the accommodation cavity 40. Of course, the above translation mechanism may also be a sliding protrusion or a slide rail, etc. Those skilled in the art can flexibly set the specific structure of the translation mechanism in practical applications, as long as the dispensing device 1 can be pulled out of the body 10 and pushed into the body 10 through the cooperation of the guide rail 20 and the translation mechanism.

Preferably, the dispensing device 1 further includes a trim panel 7, and when the dispensing device 1 is in the retracted position, the trim panel 7 is flush with an operation panel 8 of the washing machine. As shown in FIGS. 7 to 14, when the dispensing device 1 is completely received in the body 10, an outer side surface of the trim panel 7 is flush with an outer side surface of the operation panel 8 of the washing machine, that is, the outer side surface of the trim panel 7 and the outer side surface of the operation panel 8 are coplanar, thus making the washing machine have a more beautiful overall appearance.

Further preferably, the clothing treatment agent dispensing assembly of the present disclosure further includes an automatic ejection mechanism configured to automatically eject the dispensing device 1 to the extended position. The automatic ejection mechanism may be configured to eject the dispensing device 1 by a manual operation or by an automatic operation. If the automatic ejection mechanism is controlled by the automatic operation, the automatic ejection mechanism may be signal-connected to a control panel of the washing machine. When the control panel is operated, a signal may be sent to the automatic ejection mechanism, so that the automatic ejection mechanism operates to automatically eject the dispensing device 1 to the extended position. If the automatic eject mechanism is controlled by the manual operation, a button 9 may be provided on the trim panel 7, and the button 9 is configured to trigger the automatic ejection mechanism when pressed, so that the dispensing device 1 is automatically ejected to the extended position.

In a possible situation, the automatic ejection mechanism includes an elastic reset member, one end of which is connected to the body 10 or the storage container 3, and the other end of which is connected to the dispensing device 1; and when the dispensing device 1 is in the retracted position, the elastic reset member biases the dispensing device 1 in a direction away from the storage container 3. Specifically, the elastic reset member may be a spring, and the button 9 may selectively abut the spring through a connecting rod to control expansion and contraction of the spring. In a normal state (that is, when the dispensing device 1 is in the retracted position), the connecting rod abuts the spring, and when the button 9 cancels abutting the spring through the connecting rod, the spring releases its own elastic force and applies a thrust to the dispensing device 1, so that the dispensing device 1 is automatically ejected to the extended position; when the dispensing device 1 returns to the retracted position, the connecting rod abuts the spring again and causes the spring to bias the dispensing device 1. In order to ensure the smooth progress of the above operations, in practical applications, it is necessary to enable the dispensing device 1 to be smoothly locked when it is in the retracted position. In a preferred embodiment, the clothing treatment agent dispensing assembly of the present disclosure further includes a locking mechanism which includes a locking hook disposed on the dispensing device 1 or the body 10 and a buckle correspondingly disposed on the body 10 or the dispensing device 1, and when the dispensing device 1 is in the retracted position, the locking hook engages with the buckle to lock the dispensing device 1 in the retracted position. Specifically, a locking hook may be provided on the dispensing device 1, a buckle may be provided on the body 10 at a position corresponding to the locking hook, and the dispensing device 1 is locked to the body 10 through the cooperation of the locking hook and the buckle. Of course, it is also possible to dispose the locking hook on the body 10 and dispose the buckle on the dispensing device 1 so as to achieve the locking of the dispensing device 1 and the body 10. It should be noted that the above specific structures of the elastic reset member and the locking mechanism are only exemplary. For example, the elastic reset member may also be a torsion spring, and the locking mechanism may also be a structure in which a protrusion mates with a groove. Those skilled in the art can flexibly set the specific structures of the elastic reset member and the locking mechanism in practical applications, as long as the dispensing device 1 can be automatically ejected by the elastic reset member and the dispensing device 1 can be locked with the body 10 by the locking mechanism.

Preferably, the clothing treatment agent dispensing assembly of the present disclosure further includes a pumping device, which is in communication with the storage container 3 and configured to pump the clothing treatment agent in the storage container 3 to a working chamber of the washing machine. The pumping device may be a hydraulic pump, wherein one end of the hydraulic pump communicates with the storage container 3, and the other end communicates with the working chamber of the washing machine. The hydraulic pump is signal-connected to the control panel. The hydraulic pump can be turned on through the control panel so that the clothing treatment agent in the storage container 3 is injected into the working chamber, thereby completing the washing operation on the clothing. Of course, the above-mentioned pumping device being a hydraulic pump is only exemplary, and those skilled in the art can flexibly set the specific structure of the pumping device in practical applications, as long as a mixture of the detergent and the softener in the storage container 3 can be injected into the working chamber of the washing machine by the pumping device.

Third Embodiment

As shown in FIGS. 15 to 26, the clothing treatment agent dispensing assembly of the present disclosure further includes a pivoting mechanism 2, the dispensing device 1 pivots relative to the body 10 by means of the pivoting mechanism 2, and the pivoting mechanism 2 is provided therein with a flow channel which communicates the dispensing device 1 with the storage container 3. The dispensing device 1 may be a dispensing box, a dispensing board or a dispensing rack, etc., and those skilled in the art can flexibly set the specific structure of the dispensing device 1 in practical applications, as long as the dispensing device 1 can deliver the clothing treatment agent to the storage container 3 through the flow channel in the pivoting mechanism 2. In addition, in order that the storage container 3 can be fixed in the body 10, an accommodation cavity 20 for accommodating the storage container 3 and the dispensing device 1 may be provided in the body 10. The storage container 3 is fixed at the rear part of the accommodation cavity 20, and when the dispensing device 1 pivots to a closed position, the dispensing device 1 is received at the front part of the accommodation cavity 20. In addition, the clothing treatment agent includes a detergent, a softener, etc., and those skilled in the art can flexibly set the category and specific type of the clothing treatment agent in practical applications, as long as the clothing treatment agent can be used to wash the clothing. It should be noted that the pivoting mechanism 2 in the present disclosure may be a horizontal pivoting mechanism (that is, the pivot axis of the pivoting mechanism 2 is in a horizontal direction) or a vertical pivoting mechanism (that is, the pivot axis of the pivoting mechanism 2 is in a vertical direction), and those skilled in the art can flexibly set the specific structure and pivoting direction of the pivoting mechanism 2 in practical applications, as long as the pivoting mechanism 2 enables the dispensing device 1 to pivot to the extended position relative to the body 10.

Figure 23:
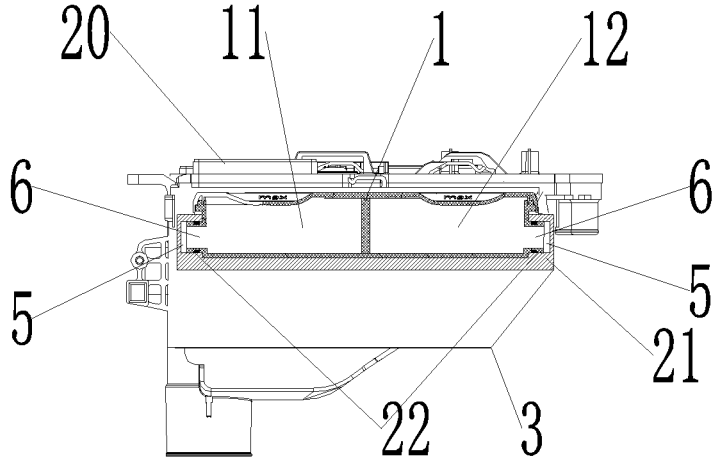
FIG. 23 is a cross-sectional view taken along line C-C in FIG. 16.
Figure 24:
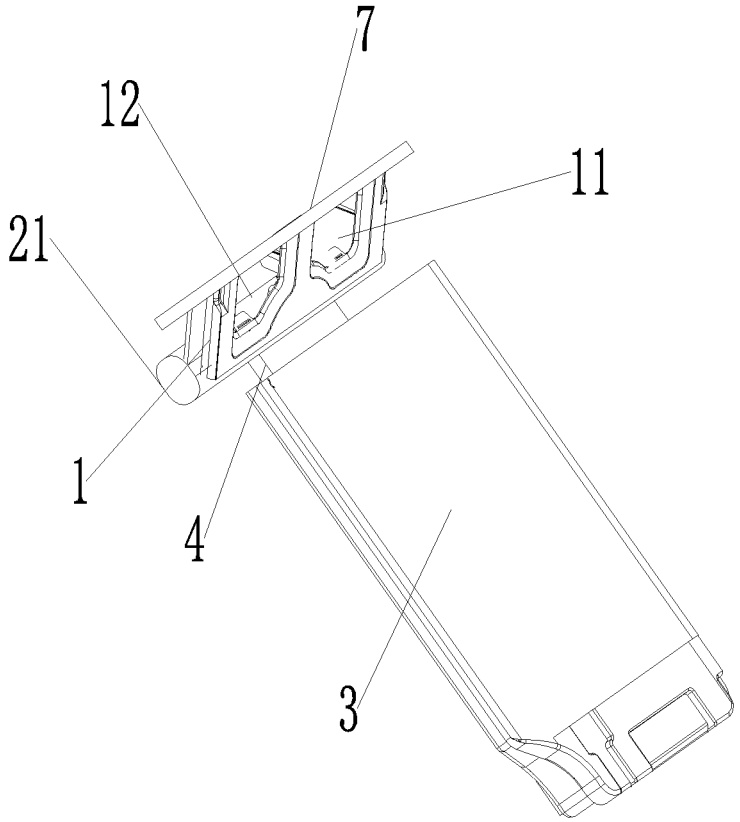
FIG. 24 is a seventh schematic structural view of the third embodiment of the clothing treatment agent dispensing assembly of the present disclosure.
Figure 25:
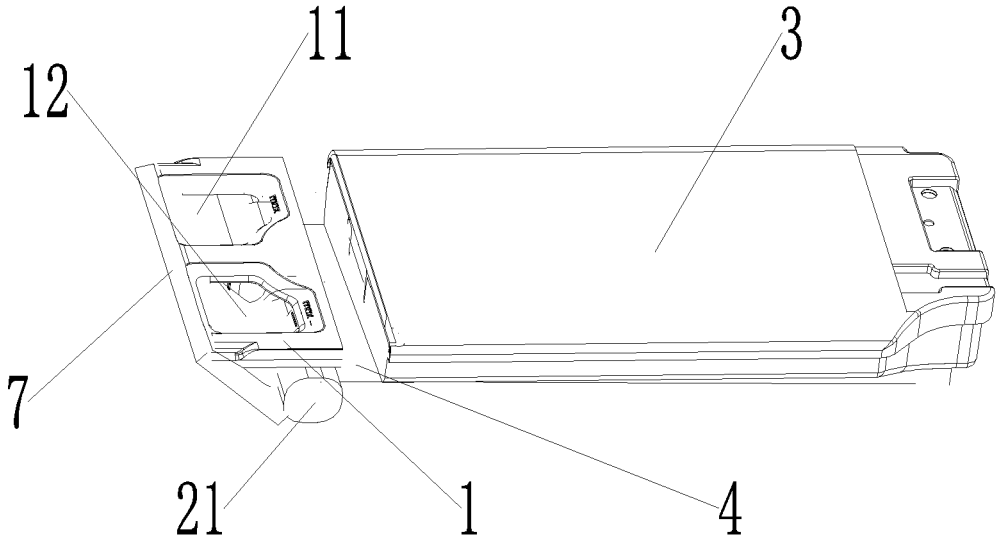
FIG. 25 is an eighth schematic structural view of the third embodiment of the clothing treatment agent dispensing assembly of the present disclosure.
Figure 26:
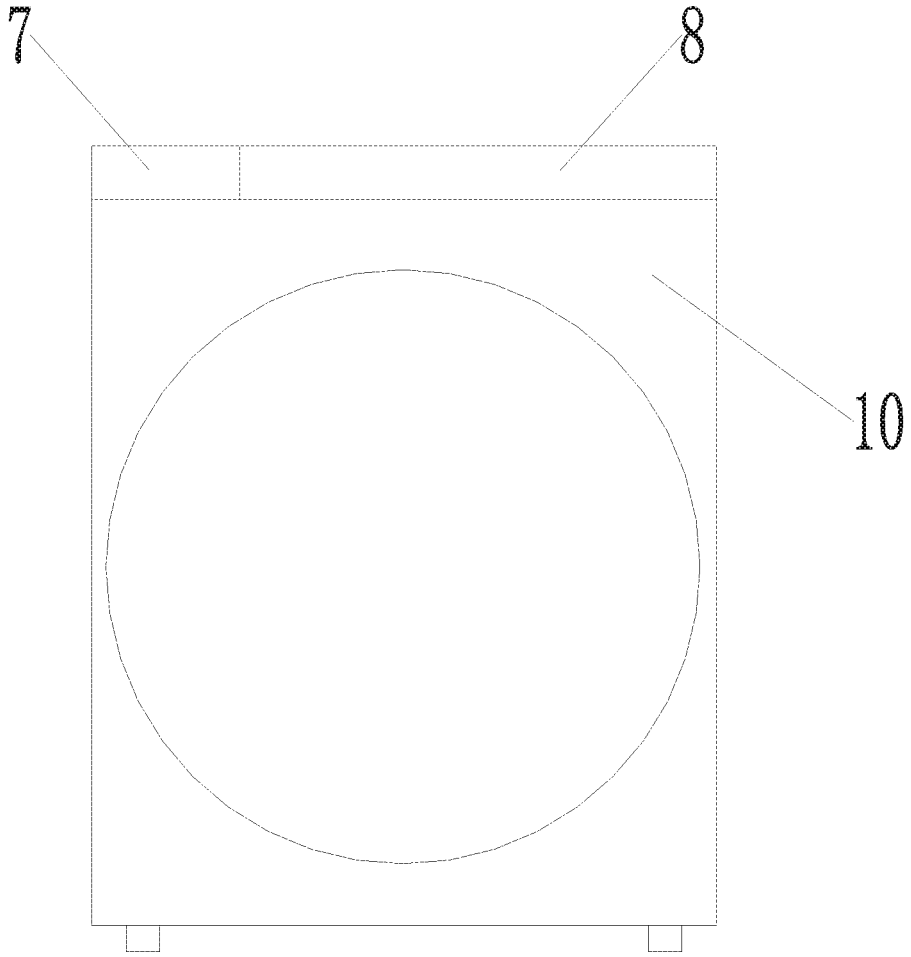
FIG. 26 is a schematic structural view of a third embodiment of the washing machine of the present disclosure.
Figure 27:
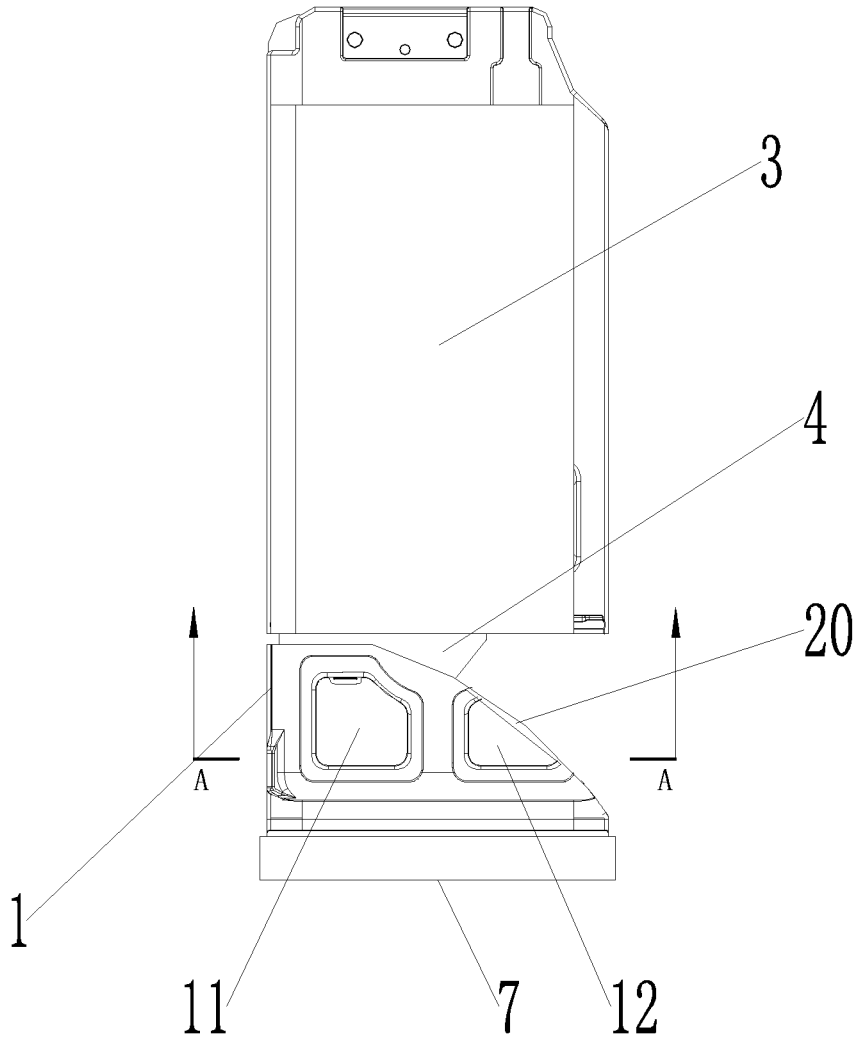
FIG. 27 is a first schematic structural view of a fourth embodiment of the clothing treatment agent dispensing assembly of the present disclosure.
Figure 28:
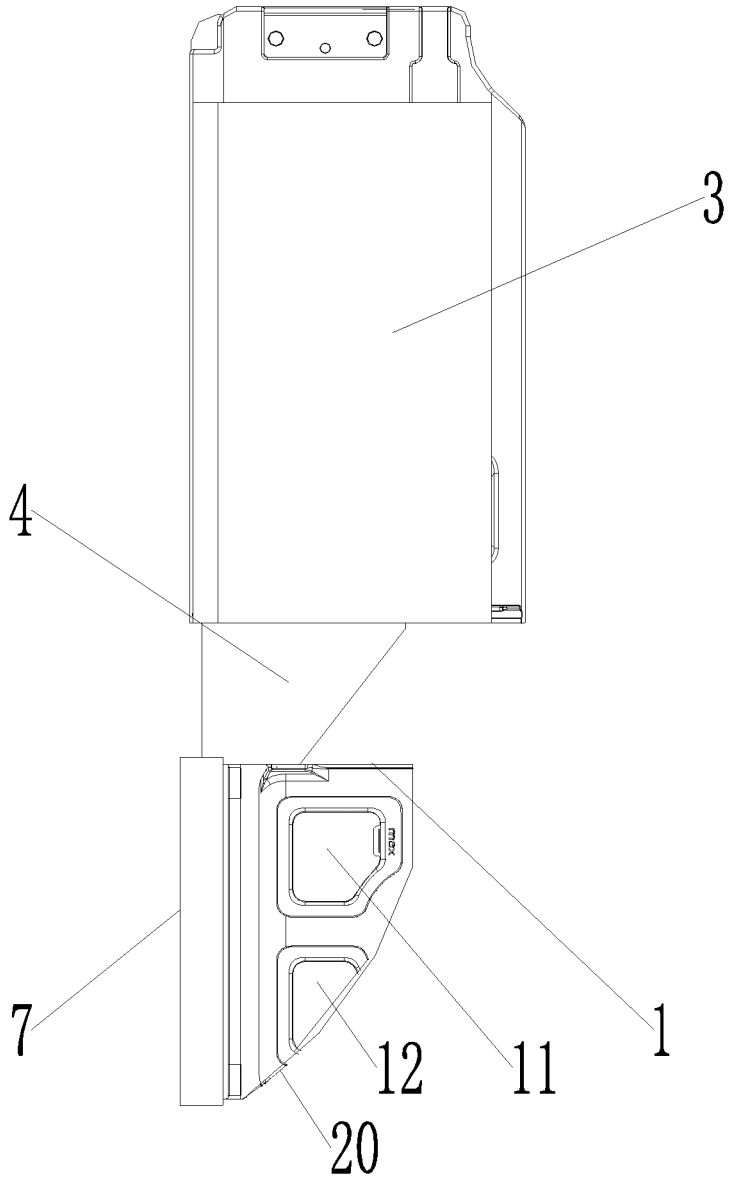
FIG. 28 is a second schematic structural view of the fourth embodiment of the clothing treatment agent dispensing assembly of the present disclosure.
Figure 29:
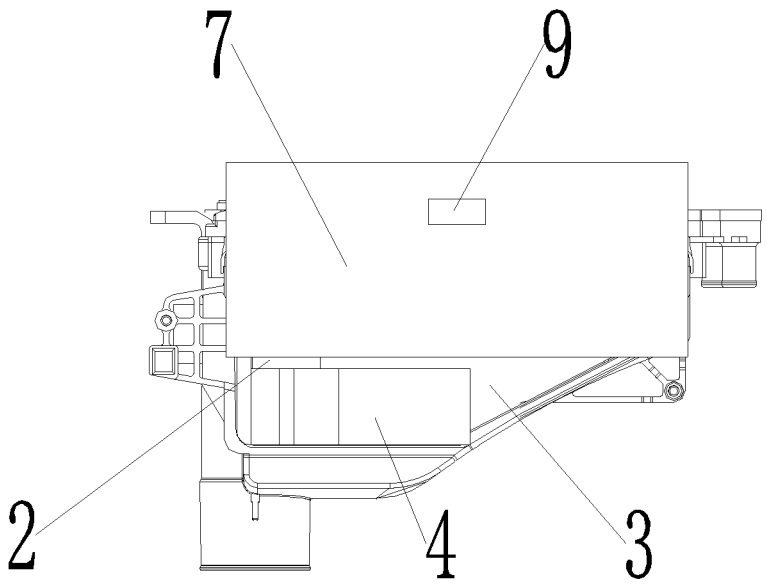
FIG. 29 is a third schematic structural view of the fourth embodiment of the clothing treatment agent dispensing assembly of the present disclosure.

Preferably, as shown in FIGS. 19 to 25, the pivoting mechanism 2 includes a shaft seat 21 and a rotating shaft 22 pivotally inserted in the shaft seat 21, the flow channel includes a first flow channel 5 disposed in the shaft seat 21 and a second flow channel 6 disposed in the rotating shaft 22, the first flow channel 5 is in communication with the storage container 3, and the second flow channel 6 is in communication with the first flow channel 5 and the dispensing device 1. With this arrangement, when the dispensing device 1 pivots to the extended position, the clothing treatment agent can be dispensed into the dispensing device 1, and the clothing treatment agent in the dispensing device 1 sequentially passes through the second flow channel 6 in the rotating shaft 22 and the first flow channel 5 in the shaft seat 21 and enters the storage container 3, so as to realize the dispensing and injection of the clothing treatment agent. In addition, the dispensing device 1 includes at least one dispensing cavity, the rotating shaft 22 is provided therein with at least one clothing treatment agent inlet corresponding to the dispensing cavity in a one-to-one correspondence, and each clothing treatment agent inlet communicates one dispensing cavity to the second flow channel 6. The number of the dispensing cavity may be one or more than one. Those skilled in the art can flexibly set the specific number of the dispensing cavity in practical applications, as long as the clothing treating agent can be dispensed into the storage container 3 through the dispensing cavity. In a possible situation, the number of the dispensing cavity is one, that is, the detergent can be first dispensed into the dispensing cavity, and then the detergent is delivered into the second flow channel 6 through one clothing treatment agent inlet. In another possible situation, as shown in FIGS. 19 to 25, the number of the dispensing cavity is two, i.e., a detergent dispensing cavity 11 and a softener dispensing cavity 12 respectively, wherein the detergent dispensing cavity 11 has a detergent dispensing port, and the softener dispensing cavity 12 has a softener dispensing port. The detergent dispensing cavity 11 can inject the detergent into the second flow channel 6 through one clothing treatment agent inlet in the rotating shaft 22; similarly, the softener dispensing cavity 12 can inject the softener into the second flow channel 6 through another clothing treatment agent inlet in the rotating shaft 22, and then the first flow channel 5 guides the detergent and the softener into the storage container 3 for storage, thereby preparing for clothing washing of the washing machine. Specifically, taking the detergent dispensing cavity 11 as an example, as shown in FIG. 23, when the dispensing device 1 pivots to the extended position, the detergent is dispensed into the detergent dispensing cavity 11 through the detergent dispensing port, the detergent flows downward and then leftward, passes through the second flow channel in the rotating shaft 22 and then enters the first flow channel 5 of the shaft seat 21, and finally enters the storage container 3 for storage. In the structure of the present disclosure, the specific flow pattern of the softener is similar to that of the detergent, and will not be repeated herein.

Preferably, the clothing treatment agent dispensing assembly of the present disclosure further includes a communication member 4 disposed between the shaft seat 21 and the storage container 3 and configured to communicate the first flow channel 5 with the storage container 3. Through the communication member 4, the maximum moving distance of the dispensing device 1 relative to the storage container 3 can be appropriately increased, that is, by providing communication members 4 of different lengths, the arrangement requirements of different washing machines can be accommodated. In addition, a bottom wall of the communication member 4 is preferably inclined downward in a direction away from the dispensing device 1, that is, the bottom wall of the communication member 4 is inclined downward in the direction from the outside to the inside of the body 10, thereby facilitating the flow of the clothing treatment agent so that the clothing treatment agent can quickly enter the storage container 3. Of course, in practical applications, the bottom wall of the communication member 4 may also be horizontally disposed, and those skilled in the art can flexibly adjust the arrangement of the bottom wall of the communication member 4 in practical applications, as long as the clothing treatment agent can be guided from the dispensing device 1 into the storage container 3 by the communication member 4.

Preferably, a sealing groove is disposed on an inner wall at both ends of the shaft seat 21 or an outer wall at both ends of the rotating shaft 22, and a sealing ring is placed in the sealing groove. Specifically, when the rotating shaft 22 is inserted in the shaft seat 21, a certain gap is formed between the rotating shaft 22 and the shaft seat 21 for ensuring that the rotating shaft 22 can smoothly rotate. In order to prevent the clothing treatment agent from leaking out of the gap, a sealing groove may be disposed on the inner wall of the shaft seat 21, and a sealing ring is placed in the sealing groove. The gap is sealed by the sealing ring, so as to ensure that the clothing treatment agent does not leak out of the gap and guarantee the sealing effect thereof. Alternatively, the sealing groove may also be disposed on the outer wall of the rotating shaft 22, and a sealing ring is also placed in the sealing groove, so that the gap is sealed by the sealing ring. In practical applications, the sealing ring may be an O-ring or other forms of sealing ring. Those skilled in the art can flexibly set the specific type of sealing ring in practical applications, as long as the rotating shaft 22 and the shaft seat 21 can be sealed by the sealing ring. In addition, in order to prevent the opening force of the dispensing device 1 from being too large and causing oscillations to result in an overflow of the clothing treatment agent, a damping member, such as a rotary damper or a rack and pinion damper, may be provided between the rotating shaft 22 and the shaft seat 21 to achieve slow opening of the dispensing device 1 through the effect of an elastic force.

It should be noted that in addition to the cooperation of the rotating shaft 22 and the shaft seat 21 shown in the above embodiment, the pivoting mechanism 2 of the present disclosure may also be in other pivoting forms, such as a gear assembly or a screw-nut sub-assembly. Those skilled in the art can flexibly set the specific structure of the pivoting mechanism 2 in practical applications, as long as the pivoting mechanism 2 enables the dispensing device 1 to pivot between the closed position and the extended position, and the flow channel in the pivoting mechanism 2 can communicate the dispensing device 1 with the storage container 3.

Preferably, a bottom wall of the dispensing cavity is inclined downward in a direction toward the storage container 3, and/or a bottom wall of the storage container 3 is inclined downward in a direction away from the dispensing device 1. Specifically, as shown in FIGS. 15 to 26, the bottom wall of the detergent dispensing cavity 11 and the bottom wall of the softener dispensing cavity 12 may each be inclined downward in a direction from the outside to the inside of the body 10, and at the same time, the bottom wall of the storage container 3 may also be correspondingly disposed to be inclined downward in a direction from the outside to the inside of the body 10, so as to facilitate a smooth flow of the detergent and the softener. Of course, in practical applications, the bottom wall of the storage container 3 may also be disposed horizontally. Such changes to the bottom wall of the storage container 3 do not deviate from the principle and scope of the present disclosure, and all belong to the scope of protection of the present disclosure.

Preferably, the dispensing device 1 further includes a trim panel 7, and when the dispensing device 1 pivots to the closed position, the trim panel 7 is flush with an operation panel 8 of the washing machine. As shown in FIGS. 15 to 26, when the dispensing device 1 is completely received in the body 10, an outer side surface of the trim panel 7 is flush with an outer side surface of the operation panel 8 of the washing machine, that is, the outer side surface of the trim panel 7 and the outer side surface of the operation panel 8 are coplanar, thus making the washing machine have a more beautiful overall appearance.

Further preferably, the clothing treatment agent dispensing assembly of the present disclosure further includes an automatic ejection mechanism configured to automatically eject the dispensing device 1 to the extended position. The automatic ejection mechanism may be configured to eject the dispensing device 1 by a manual operation or by an automatic operation. If the automatic ejection mechanism is controlled by the automatic operation, the automatic ejection mechanism may be signal-connected to a control panel of the washing machine. When the control panel is operated, a signal may be sent to the automatic ejection mechanism, so that the automatic ejection mechanism operates to automatically eject the dispensing device 1 to the extended position. If the automatic eject mechanism is controlled by the manual operation, a button 9 may be provided on the trim panel 7, and the button 9 is configured to trigger the automatic ejection mechanism when pressed, so that the dispensing device 1 is automatically ejected to the extended position.

In a possible situation, the automatic ejection mechanism includes an elastic reset member, one end of which is connected to the body 10, and the other end of which is connected to the dispensing device 1; and when the dispensing device 1 is in the closed position, the elastic reset member applies a biasing force to the dispensing device 1 that causes the dispensing device 1 to pivot toward an open position. Specifically, the elastic reset member may be a torsion spring, and the button 9 may selectively abut the torsion spring through a connecting rod to control twisting of the torsion spring. In a normal state (that is, when the dispensing device 1 is in the closed position), the connecting rod abuts the torsion spring, and when the button 9 cancels abutting the torsion spring through the connecting rod, the torsion spring releases its own torsional force and applies a thrust to the dispensing device 1, so that the dispensing device 1 is automatically ejected to the extended position; when the dispensing device 1 returns to the closed position, the connecting rod abuts the torsion spring again and causes the torsion spring to bias the dispensing device 1. In order to ensure the smooth progress of the above operations, in practical applications, it is necessary to enable the dispensing device 1 to be smoothly locked when it is in the closed position. In a preferred embodiment, the clothing treatment agent dispensing assembly of the present disclosure further includes a locking mechanism which includes a locking hook disposed on the dispensing device 1 or the body 10 and a buckle correspondingly disposed on the body 10 or the dispensing device 1, and when the dispensing device 1 pivots to the closed position, the locking hook engages with the buckle to lock the dispensing device 1 in the closed position. Specifically, a locking hook may be provided on the dispensing device 1, a buckle may be provided on the body 10 at a position corresponding to the locking hook, and the dispensing device 1 is locked to the body 10 through the cooperation of the locking hook and the buckle. Of course, it is also possible to dispose the locking hook on the body 10 and dispose the buckle on the dispensing device 1 so as to achieve the locking of the dispensing device 1 and the body 10. It should be noted that the above specific structures of the elastic reset member and the locking mechanism are only exemplary. For example, the elastic reset member may also be a spring, and the locking mechanism may also be a structure in which a protrusion mates with a groove. Those skilled in the art can flexibly set the specific structures of the elastic reset member and the locking mechanism in practical applications, as long as the dispensing device 1 can be automatically ejected by the elastic reset member and the dispensing device 1 can be locked with the body 10 by the locking mechanism.

Preferably, the clothing treatment agent dispensing assembly of the present disclosure further includes a pumping device, which is in communication with the storage container 3 and configured to pump the clothing treatment agent in the storage container 3 to a working chamber of the washing machine. The pumping device may be a hydraulic pump, wherein one end of the hydraulic pump communicates with the storage container 3, and the other end communicates with the working chamber of the washing machine. The hydraulic pump is signal-connected to the control panel. The hydraulic pump can be turned on through the control panel so that the clothing treatment agent in the storage container 3 is injected into the working chamber, thereby completing the washing operation on the clothing. Of course, the above-mentioned pumping device being a hydraulic pump is only exemplary, and those skilled in the art can flexibly set the specific structure of the pumping device in practical applications, as long as a mixture of the detergent and the softener in the storage container 3 can be injected into the working chamber of the washing machine by the pumping device.

Fourth Embodiment

As shown in FIGS. 27 to 35, the clothing treatment agent dispensing assembly of the present disclosure further includes a vertical pivoting mechanism 2, the dispensing device 1 pivots relative to the body 10 by means of the vertical pivoting mechanism 2 around a vertical axis, and the vertical pivoting mechanism 2 is provided therein with a flow channel which communicates the dispensing device 1 with the storage container 3. The dispensing device 1 may be a dispensing box, a dispensing board or a dispensing rack, etc., and those skilled in the art can flexibly set the specific structure of the dispensing device 1 in practical applications, as long as the dispensing device 1 can deliver the clothing treatment agent to the storage container 3 through the flow channel in the vertical pivoting mechanism 2. In addition, in order that the storage container 3 can be fixed in the body 10, an accommodation cavity for accommodating the storage container 3 and the dispensing device 1 may be provided in the body 10. The storage container 3 is fixed at the rear part of the accommodation cavity, and when the dispensing device 1 vertically pivots to a closed position, the dispensing device 1 is received at the front part of the accommodation cavity. In addition, the clothing treatment agent includes a detergent, a softener, etc., and those skilled in the art can flexibly set the category and specific type of the clothing treatment agent in practical applications, as long as the clothing treatment agent can be used to wash the clothing. It should be noted that the vertical direction in the vertical pivoting mechanism 2 in the present disclosure means that a pivot axis 22 of the vertical pivoting mechanism 2 is in the vertical direction.

Preferably, as shown in FIGS. 27 to 35, the vertical pivoting mechanism 2 includes a shaft seat 21 and a rotating shaft 22 pivotally inserted in the shaft seat 21, and the flow channel is disposed in the rotating shaft 22. With this arrangement, when the dispensing device 1 vertically pivots to the extended position, the clothing treatment agent can be dispensed into the dispensing device 1, and the clothing treatment agent in the dispensing device 1 flows into the storage container 3 through the flow channel in the rotating shaft 22, so as to achieve the dispensing and injection of the clothing treatment agent. In addition, the dispensing device includes at least one dispensing cavity, the rotating shaft 22 is provided therein with at least one flow guide tube corresponding to the dispensing cavity in a one-to-one correspondence, and each flow guide tube communicates one dispensing cavity to the storage container 3. Specifically, the flow guide tube is disposed in the flow channel in the rotating shaft 22, and the flow guide tube may be the entire flow channel or a part of the flow channel. For example, when the number of the dispensing cavity is one, the flow guide tube may be the flow channel, that is, the clothing treatment agent in the dispensing cavity can be guided into the storage container 3 through the flow guide tube; and when the number of the dispensing cavity is more than one, in order to ensure the smooth pivoting of the dispensing device 1 relative to the body 10, all the flow guide tubes together form a part of the flow channel, and the rotation axis 22 of one of the flow guide tubes and the rotation axis 22 of the rotating shaft 22 coincide with each other. In summary, those skilled in the art can flexibly set the specific number of the dispensing cavity in practical applications, as long as the clothing treating agent can be dispensed into the storage container 3 through the dispensing cavity. In a possible situation, as shown in FIGS. 27 to 35, the number of the dispensing cavity is two, i.e., a detergent dispensing cavity 11 and a softener dispensing cavity 12 respectively, wherein the detergent dispensing cavity 11 has a detergent dispensing port, and the softener dispensing cavity 12 has a softener dispensing port. The detergent dispensing cavity 11 can deliver the detergent into the storage container 3 through one flow guide tube in the rotating shaft 22; similarly, the softener dispensing cavity 12 can deliver the softener into the storage container 3 through another flow guide tube in the rotating shaft 22, thereby preparing for clothing washing of the washing machine. Specifically, the clothing treatment agent dispensing assembly of the present disclosure further includes a communication member 4 disposed between the shaft seat 21 and the storage container 3 and including at least one flow guide channel corresponding to the flow guide tube in a one-to-one correspondence, and each flow guide channel is configured to connect one flow guide tube to the storage container 3. That is, each of the flow guide channels can guide the clothing treatment agent in the flow guide tube communicating therewith into the storage container 3. When there are multiple flow guide channels, the flow guide channels may be arranged horizontally in the horizontal direction, or also be arranged vertically in the vertical direction. In the following, the technical solution of the present disclosure will be further elaborated by using an example in which the flow guide tube includes a first guide tube 5 and a second guide tube 6, and the flow guide channel includes a top flow guide channel 41 and a bottom flow guide channel 42.

Figure 30:
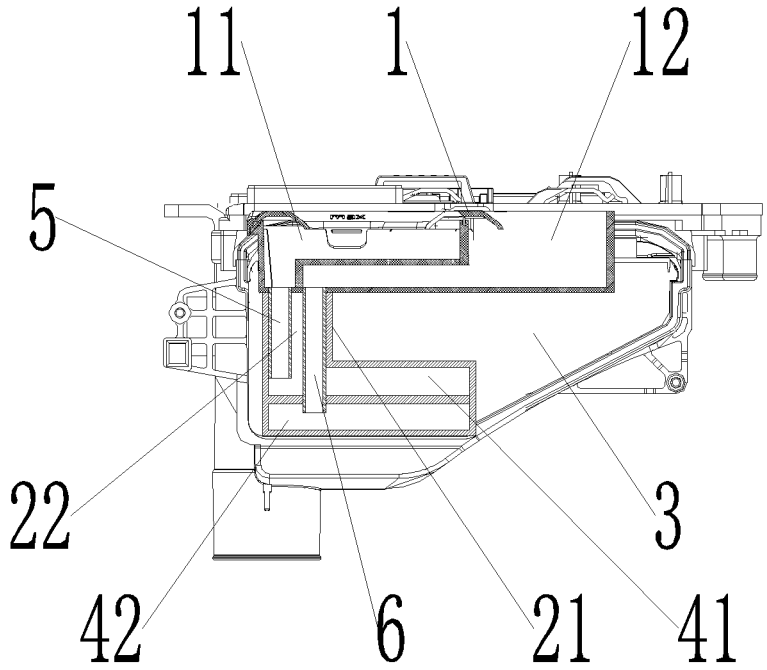
FIG. 30 is a cross-sectional view taken along line A-A in FIG. 27.
Figure 31:
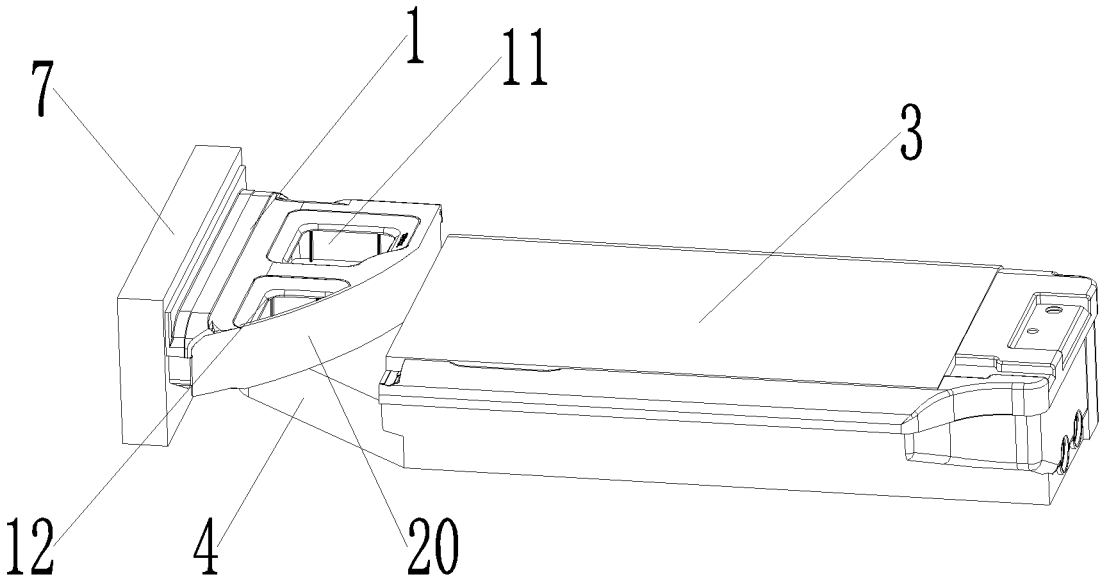
FIG. 31 is a fourth schematic structural view of the fourth embodiment of the clothing treatment agent dispensing assembly of the present disclosure.
Figure 32:
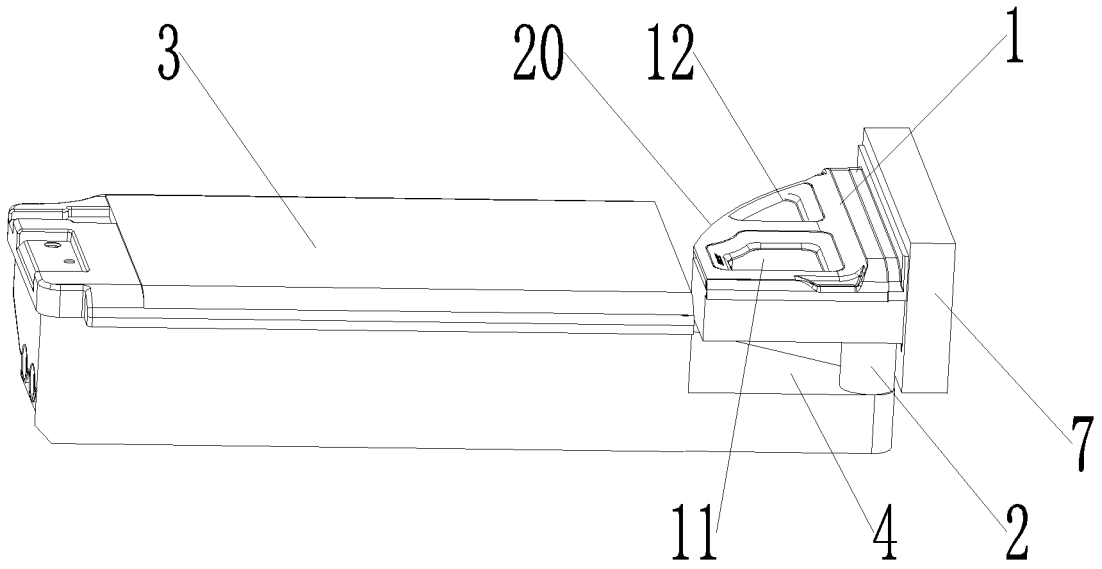
FIG. 32 is a fifth schematic structural view of the fourth embodiment of the clothing treatment agent dispensing assembly of the present disclosure.
Figure 33:
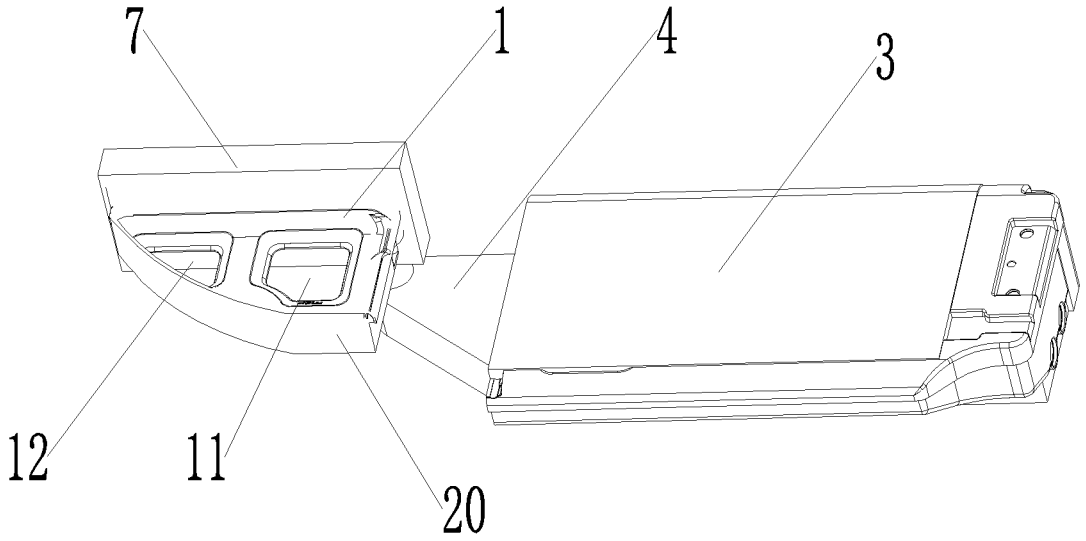
FIG. 33 is a sixth schematic structural view of the fourth embodiment of the clothing treatment agent dispensing assembly of the present disclosure.
Figure 34:
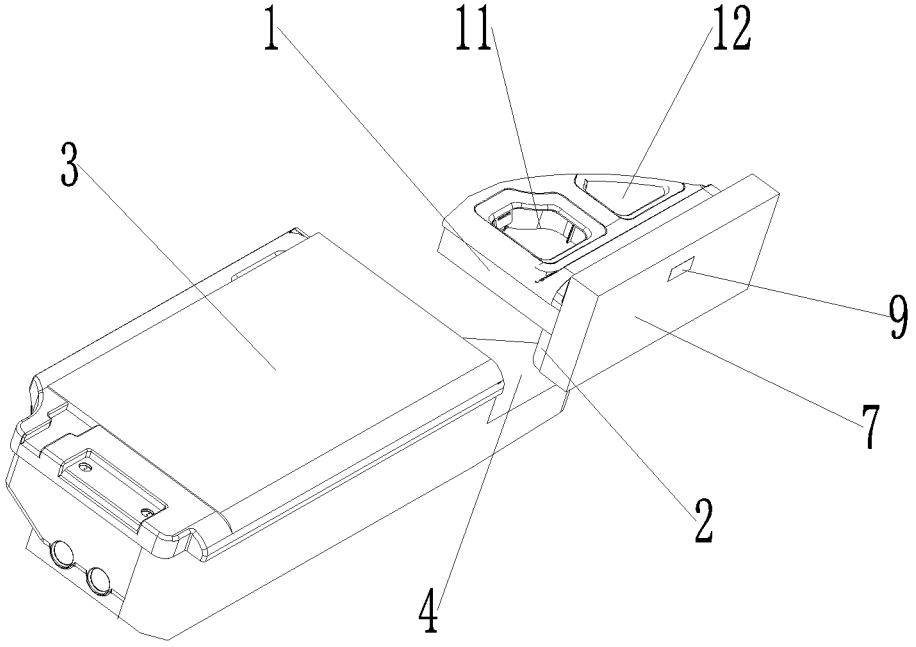
FIG. 34 is a seventh schematic structural view of the fourth embodiment of the clothing treatment agent dispensing assembly of the present disclosure.
Figure 35:
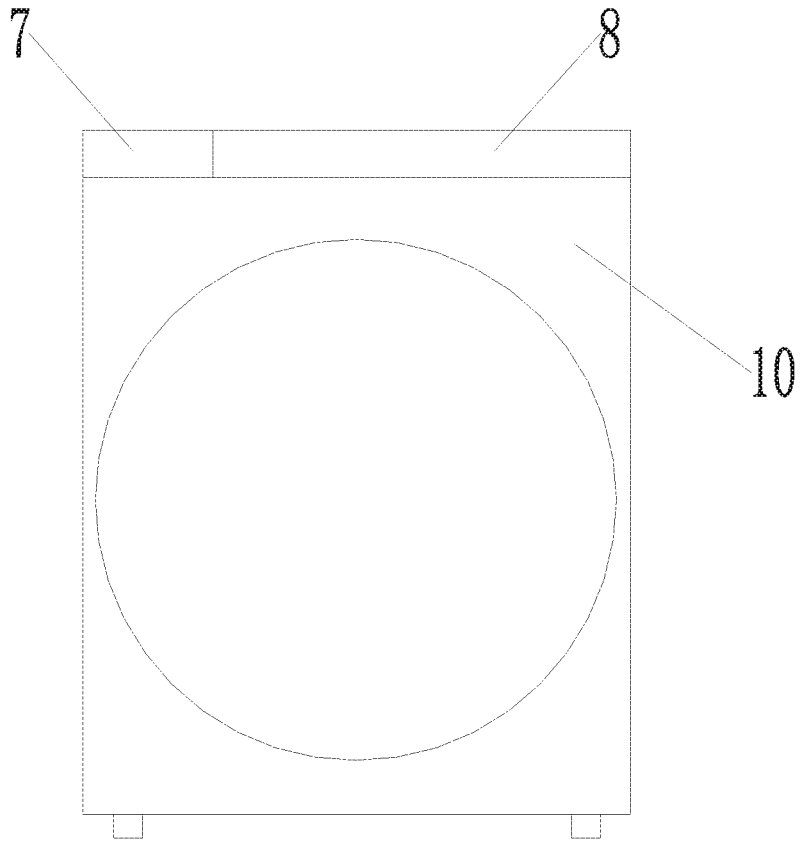
FIG. 35 is a schematic structural view of a fourth embodiment of the washing machine of the present disclosure.

Specifically, as shown in FIG. 30, the flow guide tube includes a first flow guide tube 5 and a second flow guide tube 6, and the flow guide channel includes a top flow guide channel 41 in communication with the first flow guide tube 5 and a bottom flow guide channel 42 in communication with the second flow guide tube 6; the first guide tube 5 is in communication with the detergent dispensing cavity 11, and the second guide tube 6 is in communication with the softener dispensing cavity 12. After the dispensing device 1 vertically pivots to the extended position, the detergent may be dispensed into the detergent dispensing cavity 11, and the detergent enters the storage container 3 after passing through the detergent dispensing cavity 11, the first flow guide tube 5 and the first flow guide channel in sequence; the softener enters the storage container 3 after passing through the softener dispensing cavity 12, the second flow guide tube 6 and the second flow guide channel in sequence. In addition, in order to ensure the smooth pivoting of the dispensing device 1, the rotation axis 22 of the second flow guide tube 6 and the rotation axis 22 of the rotating shaft 22 coincide with each other, so that when the dispensing device 1 pivots between the extended position and the closed position, that is, when the rotating shaft 22 pivots in the shaft seat 21, the second flow guide tube 6 rotates around its own axis, the first flow guide tube 5 swings relative to the second flow guide tube 6, the first flow guide tube 5 can always maintain the communication with the first flow guide channel, and the second flow guide tube 6 can always maintain the communication with the second flow guide channel. With this arrangement, the detergent and the softener are delivered in layers and smoothly. In addition, since the second flow guide tube 6 needs to be rotated repeatedly during actual operation, in order to ensure the tightness between the top flow guide channel 41 and the bottom flow guide channel 42, a sealing ring/sealing tape/seal bearing may be disposed at the position where the second flow guide tube 6 penetrates through a partition between the top flow guide channel and the bottom flow guide channel 42 to ensure that the clothing treatment agents inside the top flow guide channel 41 and the bottom flow guide channel 42 do not leak to each other. Of course, as an alternative, the positions of the detergent dispensing cavity 11 and the softener dispensing cavity 12 may also be interchanged, and such changes to the structure and arrangement do not deviate from the principle and scope of the present disclosure.

Preferably, a sealing groove is disposed on an inner wall of the shaft seat 21 or an outer wall of the rotating shaft 22, and a sealing ring is placed in the sealing groove. Specifically, when the rotating shaft 22 is inserted in the shaft seat 21, a certain gap is formed between the rotating shaft 22 and the shaft seat 21 for ensuring that the rotating shaft 22 can smoothly rotate. In order to prevent the clothing treatment agent from leaking out of the gap, a sealing groove may be disposed on the inner wall of the shaft seat 21, and a sealing ring is placed in the sealing groove. The gap is sealed by the sealing ring, so as to ensure that the clothing treatment agent does not leak out of the gap and guarantee the sealing effect thereof. Alternatively, the sealing groove may also be disposed on the outer wall of the rotating shaft 22, and a sealing ring is also placed in the sealing groove, so that the gap is sealed by the sealing ring. In practical applications, the sealing ring may be an O-ring or other forms of sealing ring. Those skilled in the art can flexibly set the specific type of sealing ring in practical applications, as long as the rotating shaft 22 and the shaft seat 21 can be sealed by the sealing ring. In addition, in order to prevent the opening force of the dispensing device 1 from being too large and causing oscillations to result in an overflow of the clothing treatment agent, a damping member, such as a rotary damper or a rack and pinion damper, may be provided between the rotating shaft 22 and the shaft seat 21 to achieve slow opening of the dispensing device 1 through the effect of an elastic force.

Preferably, a bottom wall of the flow guide channel is inclined downward in a direction away from the dispensing device 1, that is, the bottom wall of the flow guide channel is inclined downward in the direction from the outside to the inside of the body 10, so as to facilitate the flow of the clothing treatment agent and ensure that the clothing treatment agent can enter the storage container 3 quickly. Of course, in practical applications, the bottom wall of the flow guide channel may also be disposed horizontally, and those skilled in the art can flexibly adjust the arrangement of the bottom wall of the flow guide channel in practical applications, as long as the clothing treatment agent can be guided into the storage container 3 from the dispensing device 1 through the flow guide channel.

Preferably, a bottom wall of the dispensing cavity is inclined downward in a direction toward the storage container 3, and/or a bottom wall of the storage container 3 is inclined downward in a direction away from the dispensing device 1. Specifically, both the bottom wall of the detergent dispensing cavity 11 and the bottom wall of the softener dispensing cavity 12 may be disposed to be inclined downward in the direction from the outside to the inside of the body 10 (the "inclined" herein means that when the dispensing device 1 is in the extended position, the bottom wall of the detergent dispensing cavity 11 and the bottom wall of the softener dispensing cavity 12 are inclined downward in the direction from the outside to the inside of the body 10); at the same time, the bottom wall of the storage container 3 may also be correspondingly disposed to be inclined downward in the direction from the outside to the inside of the body 10 to facilitate the smooth flow of the detergent and the softener. Of course, in practical applications, the bottom wall of the storage container 3 may also be disposed horizontally. Such changes to the bottom wall of the storage container 3 do not deviate from the principle and scope of the present disclosure, and all belong to the scope of protection of the present disclosure.

Preferably, an inner side of the dispensing device 1 is set to have an arc shape to facilitate pivoting outward from the body. That is, in order to avoid the interference of the dispensing device 1 with the body 10 when the dispensing device 1 is pivoting, the inner side of the dispensing device 1 may be set to have an arc shape. As shown in FIGS. 27 to 35, when the dispensing device 1 pivots to the extended position, a side of the dispensing device 1 that is away from the storage container 3 is disposed as an arc structure 20, so that the opening area of the softener dispensing port is smaller than the opening area of the detergent dispensing port. By using such an arc structure 20, when the dispensing device 1 pivots to the closed position, it forms a well-defined avoidance space with the body 10 and the accommodation cavity, thereby ensuring that the dispensing device 1 can be smoothly received in the accommodation cavity.

Preferably, the dispensing device 1 further includes a trim panel 7, and when the dispensing device 1 pivots to the closed position, the trim panel 7 is flush with an operation panel 8 of the clothing treatment apparatus. As shown in FIGS. 27 to 35, when the dispensing device 1 is completely received in the body 10, an outer side surface of the trim panel 7 is flush with an outer side surface of the operation panel 8 of the washing machine, that is, the outer side surface of the trim panel 7 and the outer side surface of the operation panel 8 are coplanar, thus making the washing machine have a more beautiful overall appearance.

Further preferably, the clothing treatment agent dispensing assembly of the present disclosure further includes an automatic ejection mechanism configured to automatically eject the dispensing device 1 to the extended position. The automatic ejection mechanism may be configured to eject the dispensing device 1 by a manual operation or by an automatic operation. If the automatic ejection mechanism is controlled by the automatic operation, the automatic ejection mechanism may be signal-connected to a control panel of the washing machine. When the control panel is operated, a signal may be sent to the automatic ejection mechanism, so that the automatic ejection mechanism operates to automatically eject the dispensing device 1 to the extended position. If the automatic eject mechanism is controlled by the manual operation, a button 9 may be provided on the trim panel 7, and the button 9 is configured to trigger the automatic ejection mechanism when pressed, so that the dispensing device 1 is automatically ejected to the extended position.

In a possible situation, the automatic ejection mechanism includes an elastic reset member, one end of which is connected to the body 10, and the other end of which is connected to the dispensing device 1; and when the dispensing device 1 is in the closed position, the elastic reset member applies a biasing force to the dispensing device 1 that causes the dispensing device 1 to pivot toward an open position. Specifically, the elastic reset member may be a torsion spring, and the button 9 may selectively abut the torsion spring through a connecting rod to control twisting of the torsion spring. In a normal state (that is, when the dispensing device 1 is in the closed position), the connecting rod abuts the torsion spring, and when the button 9 cancels abutting the torsion spring through the connecting rod, the torsion spring releases its own torsional force and applies a thrust to the dispensing device 1, so that the dispensing device 1 is automatically ejected to the extended position; when the dispensing device 1 returns to the closed position, the connecting rod abuts the torsion spring again and causes the torsion spring to bias the dispensing device 1. In order to ensure the smooth progress of the above operations, in practical applications, it is necessary to enable the dispensing device 1 to be smoothly locked when it is in the closed position. In a preferred embodiment, the clothing treatment agent dispensing assembly of the present disclosure further includes a locking mechanism which includes a locking hook disposed on the dispensing device 1 or the body 10 and a buckle correspondingly disposed on the body 10 or the dispensing device 1, and when the dispensing device 1 pivots to the closed position, the locking hook engages with the buckle to lock the dispensing device 1 in the closed position. Specifically, a locking hook may be provided on the dispensing device 1, a buckle may be provided on the body 10 at a position corresponding to the locking hook, and the dispensing device 1 is locked to the body 10 through the cooperation of the locking hook and the buckle. Of course, it is also possible to dispose the locking hook on the body 10 and dispose the buckle on the dispensing device 1 so as to achieve the locking of the dispensing device 1 and the body 10. It should be noted that the above specific structures of the elastic reset member and the locking mechanism are only exemplary. For example, the elastic reset member may also be a spring, and the locking mechanism may also be a structure in which a protrusion mates with a groove. Those skilled in the art can flexibly set the specific structures of the elastic reset member and the locking mechanism in practical applications, as long as the dispensing device 1 can be automatically ejected by the elastic reset member and the dispensing device 1 can be locked with the body 10 by the locking mechanism.

Preferably, the clothing treatment agent dispensing assembly of the present disclosure further includes a pumping device, which is in communication with the storage container 3 and configured to pump the clothing treatment agent in the storage container 3 to a working chamber of the washing machine. The pumping device may be a hydraulic pump, wherein one end of the hydraulic pump communicates with the storage container 3, and the other end communicates with the working chamber of the washing machine. The hydraulic pump is signal-connected to the control panel. The hydraulic pump can be turned on through the control panel so that the clothing treatment agent in the storage container 3 is injected into the working chamber, thereby completing the washing operation on the clothing. Of course, the above-mentioned pumping device being a hydraulic pump is only exemplary, and those skilled in the art can flexibly set the specific structure of the pumping device in practical applications, as long as a mixture of the detergent and the softener in the storage container 3 can be injected into the working chamber of the washing machine by the pumping device.

Hitherto, the technical solutions of the present disclosure have been described in conjunction with the preferred embodiments shown in the accompanying drawings, but it is easily understood by those skilled in the art that the scope of protection of the present disclosure is obviously not limited to these specific embodiments. Without departing from the principle of the present disclosure, those skilled in the art can make equivalent changes or replacements to relevant technical features, and the technical solutions after these changes or replacements will fall within the scope of protection of the present disclosure.

What is claimed is:

1. A clothing treatment agent dispensing assembly for a clothing treatment apparatus, the clothing treatment apparatus comprising: a body, and the clothing treatment agent dispensing assembly comprises a storage container and a dispensing device that are connected, and the storage container is fixedly disposed in the body and configured to store a clothing treatment agent, the clothing treatment agent dispensing assembly further comprising a sleeve device, one end of which is in communication with the dispensing device and the other end of which is in communication with the storage container, so that while the dispensing device is capable of moving relative to the storage container, the clothing treatment agent in the dispensing device can also flow into the storage container.

2. The clothing treatment agent dispensing assembly according to claim 1, wherein the dispensing device comprises at least one dispensing cavity, the sleeve device comprises at least one sleeve group corresponding to the dispensing cavity in a one-to-one correspondence, and each sleeve group communicates one dispensing cavity to the storage container.

3. The clothing treatment agent dispensing assembly according to claim 2, wherein each sleeve group comprises a first end sleeve and a second end sleeve, the first end sleeve in communication with the dispensing cavity, the second end sleeve is in communication with the storage container, and the first end sleeve and the second end sleeve are sealingly sleeved with each other.

4. The clothing treatment agent dispensing assembly according to claim 3, wherein each sleeve group further comprises at least one intermediate sleeve disposed between the first end sleeve and the second end sleeve, and two ends of the intermediate sleeve are sealingly sleeved with the first end sleeve and the second end sleeve respectively.

5. The clothing treatment agent dispensing assembly according to claim 2, wherein a bottom wall of the dispensing cavity is inclined downward in a direction toward the storage container, and/or a bottom wall of the storage container is inclined downward in a direction away from the dispensing device.

6. The clothing treatment agent dispensing assembly according to claim 3, wherein the first end sleeve is connected to the bottom of a rear side wall of the dispensing cavity, and the second end sleeve is connected to the top of a front side wall of the storage container.

7. The clothing treatment agent dispensing assembly according to claim 1, wherein the dispensing device is provided with a guide rail, the body is provided with a translation mechanism matching the guide rail, and the dispensing device is capable of translating between a retracted position and an extended position relative to the storage container through the cooperation of the guide rail and the translation mechanism.

8. The clothing treatment agent dispensing assembly according to claim 7, wherein the clothing treatment agent dispensing assembly further comprises a locking mechanism which comprises a locking hook disposed on the dispensing device or the body and a buckle correspondingly disposed on the body or the dispensing device, and when the dispensing device is in the retracted position, the locking hook engages with the buckle to lock the dispensing device in the retracted position.

9. The clothing treatment agent dispensing assembly according to claim 1, wherein the clothing treatment agent dispensing assembly further comprises a pumping device, which is in communication with the storage container and configured to pump the clothing treatment agent in the storage container to a working chamber of the clothing treatment apparatus.

10. A clothing treatment apparatus, comprising the clothing treatment agent dispensing assembly according to claim 1.

* * * * *